US005622152A

United States Patent [19]

Ishida

[11] Patent Number: 5,622,152

[45] Date of Patent: Apr. 22, 1997

[54] PRESSURE STORAGE FUEL INJECTION SYSTEM

[75] Inventor: Akio Ishida, Kanagawa, Japan

[73] Assignee: Mitsubishi Jidosha Kogyo Kabushiki Kaisha, Tokyo, Japan

[21] Appl. No.: 498,104

[22] Filed: Jul. 5, 1995

[30] Foreign Application Priority Data

Jul. 8, 1994 [JP] Japan ..... 6-180648

[51] Int. Cl.[6] ..... F02M 45/04

[52] U.S. Cl. ..... 123/446; 123/447; 123/467

[58] Field of Search ..... 123/299, 300, 123/446, 447, 467

[56] References Cited

U.S. PATENT DOCUMENTS

| | | | |
|---|---|---|---|
| 4,381,750 | 5/1983 | Funada | 123/447 |
| 4,440,132 | 4/1984 | Terada et al. | 123/467 |
| 4,448,168 | 5/1984 | Komada et al. | 123/447 |
| 4,459,959 | 7/1984 | Terada et al. | 123/447 |
| 4,572,136 | 2/1986 | Takeuchi et al. | 123/447 |
| 4,590,903 | 5/1986 | Hofmann et al. | 123/447 |
| 4,711,216 | 12/1987 | Takeuchi et al. | 123/447 |
| 4,712,528 | 12/1987 | Schaffitz | 123/447 |
| 4,784,101 | 11/1988 | Iwanaga et al. | 123/446 |
| 4,878,471 | 11/1989 | Fuchs | 123/300 |
| 5,176,120 | 1/1993 | Takahashi | 123/446 |

*Primary Examiner*—Thomas N. Moulis
*Attorney, Agent, or Firm*—Keck, Mahin & Cate

[57] ABSTRACT

A pressure storage (common rail) fuel injection system for an engine is provided, in which the fuel injection pressure rise response when quickly accelerating the engine is improved, engine output shortage is prevented, engine noise is reduced, and improvement is made with respect to soot generation and exhaust gas particulation. A booster is provided to boost pressurized fuel fed out from a pressure storage with a directional control valve for piston operation. Low pressure fuel injection in which fuel from the pressure storage is fed directly to fuel injection valve for injection, and high pressure fuel injection in which fuel having been boosted by the booster is fed to the fuel injection valve for injection, are switched one over to the other by a directional control valve for fuel injection control.

19 Claims, 20 Drawing Sheets

PRESSURE STORAGE FUEL INJECTION SYSTEM

BACKGROUND OF THE INVENTION

1. Field of the Invention

This invention relates to pressure storage (or common rail) fuel injection systems, in which high pressure fuel stored in pressure storage (or common rail) is injected into cylinders at predetermined injection timings.

2. Description of the Prior Art

In such a pressure storage fuel injection system, fuel is fed from a high pressure fuel pump to a pressure storage for storing pressure therein, and then injected through fuel injection valves into engine cylinders at injection timings predetermined through an electronic control or the like. This system is important in large size diesel engines for ships, and has recently become applied to diesel engines for small size, high speed vehicles (such as buses and trucks).

The pressure storage fuel injection system, unlike well-known jerk fuel injection systems, is free from the disadvantage of injection pressure reduction at low speed, that is, it permits high pressure injection to be readily realized at low speed as well. Thus, it has pronounced advantages in that it permits fuel cost reduction, output increase, soot reduction, etc.

FIG. 11 shows a prior art pressure storage fuel injection system used for vehicle exclusive engines.

Referring to this Figure, designated at 10 is a fuel injection valve assembly. The fuel injection valve assembly 10 has a nozzle 16 having a row of fuel injection ports 12 provided at the end and a fuel pool storing fuel supplied to the ports 12.

In the nozzle 16, a needle valve 18 is fitted slidably for controlling the communication of the fuel pool 14 and fuel injection port 12 with each other. The needle valve 18 is always biased in the closing direction by a spring 24 via a push rod 22 which is accommodated in a nozzle holder 20. In the nozzle holder 20 a fuel chamber 26 is defined. In the fuel chamber 26 is slidably fitted a pressure application piston 28 which is coaxial with the needle valve 18 and push rod 22.

The fuel chamber 26 is communicated through a uni-directional valve 30 and an orifice 32 parallel therewith with a first outlet line b of a three-way electromagnetic valve 34. The electromagnetic valve 34 has an inlet line a communicating with a pressure storage 6 and a second outlet line c communicating with a fuel tank 38. The first outlet line b is selectively communicated with the inlet line a or the second outlet line c by a valve body 42 which is driven by an electromagnetic actuator 40. When the electromagnetic actuator 40 is de-energized, the inlet line a is communicated with the first outlet line b. When the actuator 40 is energized, the first outlet line b is communicated with the second outlet line c. In the nozzle holder 20 and nozzle 16, a fuel line 44 is provided which communicates the fuel pool 14 with the pressure storage 36.

Fuel under a high pressure predetermined in advance according to the engine operating condition is supplied to the pressure storage 36 by the high pressure fuel pump 46. The high pressure fuel pump 46 has a plunger 50 which is driven for reciprocation by an eccentric ring or cam 48 driven in an interlocked relation to the engine crankshaft. Fuel which is supplied from a fuel tank 38 to pump chamber 54 in the pump 46 is pressurized by the plunger 50 to be pumped out through a uni-directional valve 56 to the pressure storage 36.

A spill valve 64 is provided between a discharge side line 58 leading from the pump chamber 54 of the high pressure fuel pump and a withdrawal side line 60 leading to the feed pump 52. The spill valve is on-off operated by an electromagnetic actuator 62. The electromagnetic actuator 62 and the electromagnetic actuator 40 of the three-way electromagnetic valve 34 are controlled by a controller 66.

The controller 66 controls the electromagnetic actuators 40 and 62 according to output signals of a cylinder discriminator 68 for discriminating the individual cylinders of multi-cylinder engine, an engine rotation rate/crank angle sensor 70, an engine load sensor 72 and a fuel pressure sensor 74 for detecting the fuel pressure in the pressure storage 36, as well as, if necessary, such auxiliary information 76 as detected or predetermined input signals representing atmospheric temperature and pressure, fuel temperature, etc. affecting the engine operating condition.

Briefly, the pressure storage fuel injection system having the structure as described operates as follows.

The plunger 50 of the high pressure fuel pump 46 is driven by the eccentric ring or cam 48 which is driven in an interlocked relation to the engine crankshaft, and low pressure fuel supplied to the pump chamber 54 by the feed pump 52 is pressurized to a high pressure to be supplied to the pressure storage 36.

According to the engine operating condition, the controller 66 supplies a drive output to the electromagnetic actuator 62 for on-off operating the spill valve 64. The spill valve 64 thus sets a predetermined pressure (for instance 20 to 120 MPa) as fuel pressure in the pressure storage 36.

Meanwhile, a detection signal representing the fuel pressure in the pressure storage 36 is fed back from the sensor 74 to the controller 66.

The high pressure fuel in the pressure storage 36 is supplied through the fuel line 44 of the fuel injection valve 10 to the fuel pool 14 to push the needle valve 18 upward, i.e., in the opening direction. In the meantime, when the fuel injection valve 10 is inoperative, the electromagnetic actuator 40 for the three-way electromagnetic valve 34 is held de-energized, thus having the inlet a and first outlet b in communication with each other. In this state, high pressure fuel in the pressure storage 36 is supplied through the uni-directional valve 30 and orifice 32 to the fuel chamber 26.

At this time, the pressure application piston 28 in the fuel chamber 26 is held pushed downward by the fuel pressure in the chamber 26, and a valve opening force which is the sum of the downward pushing force of the fuel pressure and the spring force of the spring 24 is being applied via the push rod 22 to the needle valve 18. The needle valve 18 is thus held at its closed position as illustrated because the area, on which the fuel pressure acts downward on the pressure application piston 28, is set to be sufficiently large compared to the area, on which fuel pressure acts upward on the needle valve 18, and further the downward spring force of the spring 24 is acting additionally.

When the electromagnetic actuator 40 is energized by drive output of the controller 66, the communication between the inlet line a and first outlet line b is blocked and, instead, the first outlet line b and second outlet line c are communicated with each other, thus communicating the fuel chamber 26 through the orifice 32 and second outlet line c with the fuel tank 38 and removing the fuel pressure having acted on the pressure application piston 28. The upward fuel pressure acting on the needle valve 18 thus comes to surpass the spring force of the spring 24, thus opening the needle valve 18 to cause injection of high pressure fuel from the fuel pool through the fuel injection port 12 into the cylinder.

After the lapse of a predetermined period of time set according to the engine operating condition, the controller 66 de-energizes the electromagnetic actuator 40, whereupon the inlet line a and first outlet line b of the three-way electromagnetic valve 34 are communicated again with each other, causing the fuel pressure in the pressure storage 36 to be applied to the pressure application piston 28. As a result, the needle valve 18 is closed, thus bringing an end to the fuel injection.

The optimum fuel injection pressure for engine performance of the above pressure storage fuel injection system, will now be considered.

(1) Under low load, the high pressure injection deteriorates the fuel consumption (i.e., fuel consumption rate). This means that it is necessary to provide high pressure injection under this condition.

Under high load, it is necessary to provide high pressure injection for the purposes of reducing the soot generation and reducing the exhaust gas particulation.

(2) Setting the high pressure injection over the entire engine operating condition leads to engine noise increase due to increase of the initial combustion (i.e., preliminary air-fuel mixture combustion).

From the standpoint of suppressing the engine noise, the fuel injection pressure is desirably made as low as possible to an extent having no adverse effects on the exhaust gas state and fuel cost, and the fuel injection pressure during idling and under low load of the engine is adequately about 20 to 30 MPa.

From the above technical standpoints, the prior art pressure storage fuel injection system shown in FIG. 11 has the following problems.

A. When high pressure injection under low load is quickly changed to high load such as when quickly accelerating the vehicle, a certain time is taken until the pressure storage pressure increases to the requested level. Due to this delay in the pressure increase response, it is impossible to inject a large amount of fuel while holding the low pressure fuel injection, and the desired amount of fuel can not be injected, thus resulting in engine output shortage at the time of transient operation requiring quick acceleration.

In the prior art pressure storage fuel injection system, as shown in FIG. 14, during idling the common rail pressure (i.e., pressure in the pressure storage) has to be controlled to 20 MPa for reducing noise and ensuring smooth rotation. Under a low load engine operating condition, the pressure has to be controlled to 30 to 40 MPa for preventing fuel cost deterioration. Further, under a high load engine operating condition the pressure has to be controlled to 80 to 120 MPa for reducing soot generation and particulation. With such structure where the common rail pressure is varied in the above way, however, when the pressure storage pressure is quickly increased from low pressure injection (for instance under 20 MPa) under low load to high pressure injection (for instance 90 MPa) under high load, a delay is generated in the common rail pressure increase from 20 MPa to 90 MPa, thus causing the fuel injection during the open state of the needle valve to be less than the injection under predetermined pressure. Consequently, the engine output during the quick acceleration becomes less than the predetermined engine output. For example, as shown in FIG. 15, the instantaneous engine torque during the engine acceleration becomes greatly lower than the engine torque with the conventional row fuel injection pump.

The lines (a) to (c) in FIG. 15 show a relation between the engine crankshaft torque and the engine rotation rate, with the line (a) showing the relation obtained with a prior art pressure storage fuel injection system, the line (b) showing the relation obtained with a well-known row fuel injection pump, FIG. 15 and the line (c) showing the relation obtained with a pressure storage fuel injection system to be described later according to the invention.

B. To preclude the above drawback, the valve opening time of the fuel injection valve of the pressure storage fuel injection system may be prolonged to maintain the desired fuel injection. In such a case, however, the fuel injection is increased in the low pressure injection, thus resulting in the increase of black soot and particulation in the exhaust gas.

C. In connection with the above problems A and B, with the prior art common rail fuel injection system the instantaneous engine torques at intermediate and low engine rotation rates during quick acceleration of the engine are very low compared to the case of the well-known row fuel injection pump under the assumption that the maximum engine output is equal. Therefore, the acceleration character of the vehicle is greatly reduced.

To solve this problem, there is a fuel injection system which has been proposed as an invention disclosed in Japanese Patent Laid-Open Publication No. 93936/1994. In this system, two common rails (i.e., pressure storages), that is, a high and a low pressure side common rail system, are provided for switching one over to the other in dependence on the engine operating condition.

However, such a fuel injection system having the high and low pressure common rails requires, correspondingly two different, i.e., high and low pressure, fuel injection systems. Such a system is complicated in construction and increased in size so that its mounting in a vehicle engine encounters difficulties.

In the meantime, in diesel engines the fuel supply in one combustion cycle is made separately for pilot injection and regular injection under such an engine operating condition as low rotation rate in order to cope with noise. However, under a high load, low rotation rate condition, it is suitable to permit the pilot injection to be made under low pressure and the regular injection under high pressure.

SUMMARY OF THE INVENTION

An object of the invention is to provide a pressure storage fuel injection system for an engine, which has excellent response to fuel injection pressure increase during quick acceleration of the engine.

Another object of the invention is to provide a pressure storage fuel injection system for an engine, in which the fuel injection pressure for pilot injection and that for regular injection can be switched one over to the other.

To attain these objects of the invention, there is provided a pressure storage fuel injection system, which comprises:

fuel feeding means for feeding fuel pumped out from a pressure application pump through control of the fuel pressure to a predetermined pressure;

a pressure storage for storing fuel fed out from the fuel feeding means in a predetermined state;

a fuel feeding line for feeding fuel to a fuel pool provided for fuel to be injected in a fuel injection valve;

a fuel control line branching from the fuel feeding line and leading to a fuel chamber formed for needle valve on-off control in the fuel injection valve;

a first directional control valve provided for fuel injection control in the fuel control line, the first directional control valve being operable to apply a fuel pressure to the fuel chamber so as to close the needle valve in the fuel injection valve and cease application of the fuel pressure to the fuel chamber so as to open the needle valve;

a first cylinder chamber formed in the fuel feeding line;

a boosting piston provided in the first cylinder chamber and operable for reducing a volume of the first cylinder chamber so as to boost the fuel pressure on the downstream side of the first cylinder chamber;

a fuel supply circuit supplying fuel from the pressure storage to the fuel feeding line and to the boosting piston;

a second directional control valve provided for operating the boosting piston in the fuel supply circuit and operable to on-off switch application of fuel pressure to the boosting piston, thus driving the boosting piston; and a controller for providing control signals to the first directional control valve for the fuel injection control and the second directional control valve for operating the boosting piston to control the on-off control of the needle valve and operation of the boosting piston.

Preferably, the controller outputs control signals to the first and second directional control valves to switch a high pressure fuel injection mode corresponding to the operative state of the boosting piston and a low pressure fuel injection mode corresponding to the inoperative state of the boosting piston.

Also, preferably the controller detects at least the engine load as an engine operating condition and causes the low pressure fuel injection mode under a low load engine operating condition and the high pressure fuel injection mode under a high load engine operating condition.

Further, preferably the controller controls fuel injection to the engine by switching the fuel injection pressure such that small amount fuel injection corresponding to pilot fuel injection and large amount fuel injection corresponding to main fuel injection are effected in one combustion cycle. More specifically, the small amount fuel injection corresponding to the pilot fuel injection is effected in the low pressure fuel injection mode, while effecting the subsequent large amount fuel injection corresponding to the main fuel injection in dependence on the engine operating condition. For example, the low pressure fuel injection mode is caused under a low load engine operating condition, while causing the high pressure fuel injection mode under a high load engine operating condition.

The boosting piston is provided in the fuel feeding liner on the upstream side of the branching point of the fuel control line, and it includes a small diameter part slidable in the first cylinder chamber and a large diameter part slidably disposed in a second cylinder chamber formed adjacent the first cylinder chamber and operatively coupled to the small diameter part.

In this case, the boosting piston may include as separate parts the small diameter part slidable in the first cylinder chamber and a large diameter part slidable in the second cylinder chamber, and further a spring is accommodated in at least one of the first and second cylinder chambers for biasing the small diameter part of the boosting piston in a direction of increasing the volume of the first cylinder chamber.

The first cylinder chamber is formed as an increased sectional area portion of the fuel feeding line, the outlet of the fuel feeding line to the first cylinder chamber being opened when the boosting piston is rendered inoperative and closed when the boosting piston is rendered operative.

The fuel supply circuit is operable to introduce pressure to one of sub-chambers in the second cylinder chamber to cause sliding of the large diameter part of the boosting piston with a pressure corresponding to the area difference between the large and small diameter parts such as to reduce the volume of the first cylinder chamber, thus boosting the fuel pressure on the downstream side of the first cylinder chamber.

The fuel supply circuit supplies fuel pressure in the fuel feeding line on the upstream side of the first cylinder chamber to which the pressure is introduced through the fuel supply circuit or in the pressure storage.

Operating fluid other than fuel may be used. In this case, the operating fluid is pumped out by a pressure application pump provided separately from the fuel feeding means to generate operating fluid pressure.

The fuel supply circuit may include a first fuel line for applying the fuel pressure to one of the sub-chambers and a second fuel line for applying the fuel pressure to the other sub-chamber, the second directional control valve provided in the second fuel line being operable for switching to apply the operating fluid pressure to the other sub-chamber so as to prohibit the sliding of the large diameter part of the boosting piston and thus render the boosting piston inoperative and cease the operating fluid application to the other sub-chamber so as to allow sliding of the large diameter part of the boosting piston and thus render the boosting piston operative for boosting the fuel pressure. More specifically, the fuel supply circuit includes a second cylinder chamber accommodating the large diameter part of the boosting piston and a fuel line, which communicates the second cylinder chamber with the fuel feeding line on the upstream side of the first cylinder chamber or with the pressure storage, and in which the second directional control valve for operating the boosting piston is mounted, the boosting piston being operable with a pressure based on the area difference between the large and small diameter parts such as to reduce the volume of the first cylinder chamber.

Further, the fuel supply circuit, as shown in FIG. 10, includes a first fuel line for applying the operating fluid pressure to one of sub-chambers and a third fuel line for communicating the other sub-chamber with atmosphere, the operating fluid pressure application to one of the sub-chambers being caused to allow sliding of the large diameter part of the boosting piston and thus render the boosting piston operative for boosting the fuel pressure and being ceased to prohibit sliding of the large diameter portion of the boosting piston and render the boosting piston inoperative.

With the structure as described according to the invention, with the switching of the second directional control valve for piston operation the pressurized fuel from the pressure storage directly flows into the fuel pool in the fuel injection valve to switch the first directional control valve for fuel injection control such as to block the pressure to the fuel chamber for needle valve on-off control and cause draining of the pressurized fuel in the fuel chamber. The needle valve is opened to cause injection of low pressure fuel in the fuel pool, having been pressurized by the sole pressurized fuel in the pressure storage, into the cylinder.

Subsequently, fuel pressure is applied to the boosting piston by the second directional control valve such as to bring about the boosting action of the boosting piston, whereby the pressurized fuel from the pressure storage is further pressurized by the action of the boosting piston to momentarily become high pressure fuel fed to the fuel pool in the fuel injection valve. Then, with the opening of the needle valve the high pressure fuel is injected likewise into the cylinder by the action of the first directional control valve. It is thus possible to obtain improved fuel injection pressure response under transient engine operating conditions.

Further, the controller makes such a control as to cause low pressure pilot fuel injection with the sole pressure application by the pressurized fuel in the pressure storage in the initial stage fuel injection and cause the high pressure main fuel injection of high pressure fuel pressurized by the boosting piston subsequent to the pilot fuel injection. It is thus possible to reduce engine noise without sacrifice of the fuel injection performance.

Thus, according to the invention the switching from the low pressure fuel injection to the high pressure fuel injection can be obtained momentarily by merely causing the switching of booster operation with the second directional control valve (i.e., three-way electromagnetic valve) with a comparatively simple system, which is obtained by adding to the conventional pressure storage fuel injection system the booster with the boosting piston and the second directional control valve (three-way electromagnetic valve) for switching the booster operation. For example, the system according to the invention permits momentary switching over to high pressure fuel injection under a transient engine operating condition requiring quick acceleration. It is thus possible to obtain great improvement of the response of the fuel injection pressure increase under a transient engine operating condition.

It is thus possible to prevent engine output reduction, generation of black soot, exhaust gas particulation deterioration and other inconveniences that might otherwise result from insufficient fuel injection pressure increase under a transient engine operating condition when quickly accelerating the vehicle.

Further, in the fuel injection in which fuel is injected twice by pilot fuel injection and main fuel injection in one combustion cycle, the pilot fuel injection, i.e., low pressure injection, and the main fuel injection, i.e., high pressure injection, using the booster can be combined as desired. It is thus possible to realize the high output operation while suppressing the engine noise.

Further, the pressure storage side fuel may be under low pressure. This means that low pressure is applied to tubing joint seals, that is, load on the seal members provided by the fuel pressure can be alleviated so that it is possible to eliminate fuel leaks.

Figure 1:
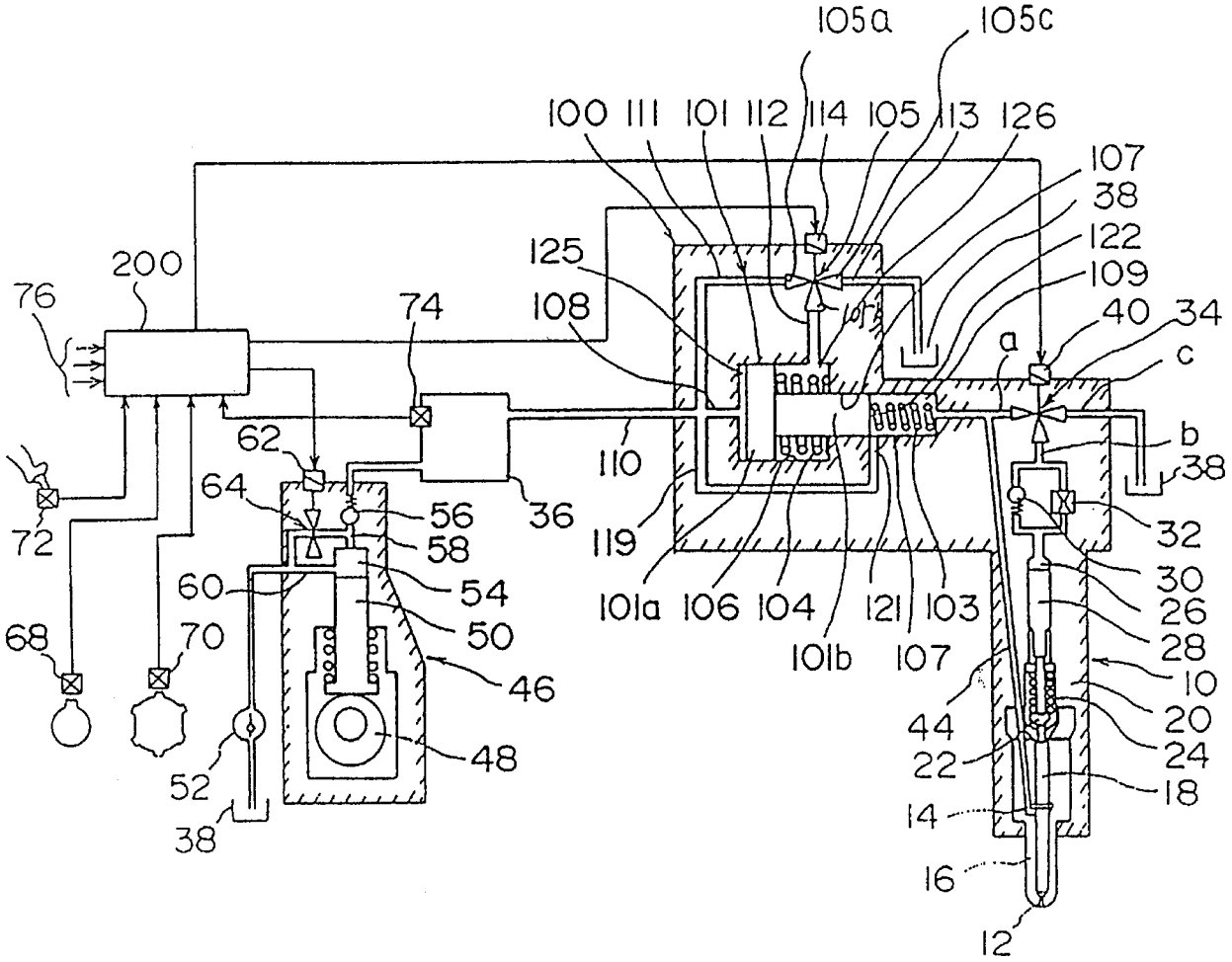
FIG. 1 is a schematic representation of an embodiment of the pressure storage fuel injection system according to the invention.

In the drawings, reference numeral 10 designates a fuel injection valve, 12 a fuel injection port, 14 a fuel pool, 18 a needle valve, 26 a fuel chamber, 28 a pressure application piston, 34 a three-way electromagnetic valve for fuel injection valve, 36 a pressure storage (common rail), 44 a fuel feeding line, 46 a pressure application pump, 100 a booster storage, 101 a boosting piston, 101*a* a large diameter part of boosting piston, 101*b* a small diameter part of boosting piston, 105 a three-way electromagnetic valve for booster, 109 a small diameter fuel chamber, 126 a medium diameter fuel chamber, 125 a large diameter fuel chamber, 108, 111, 112, 113, 119 lines, and 200 a controller.

DETAILED DESCRIPTION OF THE PREFERRED EMBODIMENTS

Now, embodiments of the invention will be exemplarily described in detail with reference to the drawings. It is to be construed that unless otherwise specified, that the sizes, materials, shapes, relative positions and so forth of parts in the embodiments as described, are given without any sense of limiting the scope of the invention but as mere examples.

Figure 2A:
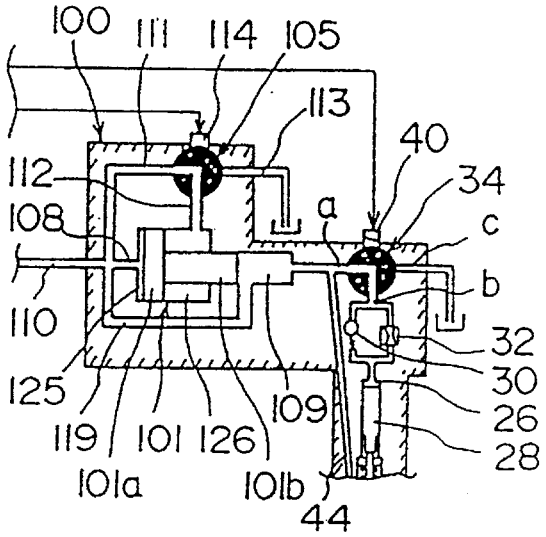
FIGS. 2(*a*) to 2(*c*) are views for explaining operation of fuel injection made with the sole pressure of a pressure storage 36, FIG. 2(*a*) showing a state before the fuel injection, FIG. 2(*b*) showing a state at the commencement of the fuel injection, and FIG. 2(*c*) showing a state at the end of the fuel injection.
Figure 2B:
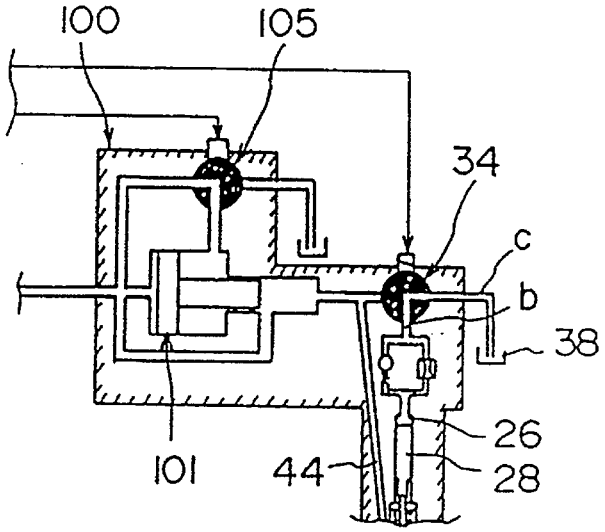
Figure 2C:
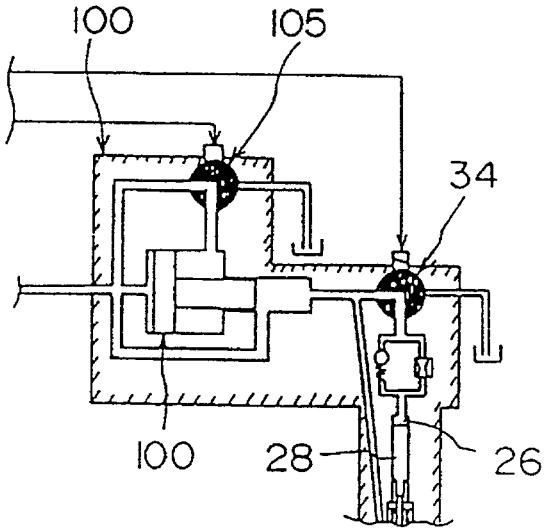

FIG. 1 is a schematic illustration showing an embodiment of the pressure storage (common rail) fuel injection system according to the invention applied to an automotive engine, and FIGS. 2(*a*) to 9 are function explanation views and fuel injection mode graphs concerning the same embodiment.

Referring to FIG. 1, designated at 10 is a fuel injection valve assembly, at 52 a fuel pump, at 46 a pressure application pump for pressurizing fuel from the fuel pump 52, at 36 a pressure storage (common rail) for storing pressurized fuel supplied from the pressure application pump 46, and at 200 a controller.

The fuel injection valve assembly 10 includes a nozzle 16 having a row of fuel injection ports 12 provided at the end and a fuel pool 14 for storing fuel to be supplied to each fuel injection port 12.

In the nozzle 16, a needle 18 is slidably accommodated, which controls the communication between the fuel pool 14 and each fuel injection port 12. The needle valve 18 is always biased in the closing direction by a spring 24 via a push rod 22 accommodated in the nozzle holder 20. In the nozzle holder 20, a fuel chamber 26 is formed. In the fuel chamber 26, a piston 28 is slidably fitted, which is coaxial with the needle valve 18 and push rod 22.

The fuel chamber 26 is communicated via a uni-directional valve 30 and an orifice 32 parallel therewith with a first outlet line b (control line) of a three-way electromagnetic valve (i.e., controlled fuel injection control valve) 34. The electromagnetic valve 34 further has an inlet line a communicating with a booster 100 to be described later and a second outlet line c communicating with a fuel tank 38. The first outlet line b is selectively communicated with the inlet line a and or the second outlet line c by a valve body which is driven by an electromagnetic actuator 40. When the electromagnetic actuator 40 is de-energized, the inlet line a is communicated with the outlet line b. When the electromagnetic actuator 40 is energized, the first outlet line b is communicated with the second outlet line c. In the nozzle holder 20 and nozzle 16, a fuel line (i.e., fuel supply line) 44 is provided which communicates the fuel pool 14 with the booster 100. Fuel under a high pressure (for instance 20 to 40 MPa) predetermined according to the engine operating condition is supplied from the pressure application pump 46 to the pressure storage 36. The application pump 46 includes a plunger 50 which is driven for reciprocation by an eccentric ring or cam 48 driven in an interlocked relation to the engine crankshaft. Fuel under low pressure, supplied from a fuel tank 38 into a pump chamber 54 of the pump 46 by a fuel pump 52, is pressurized by the plunger 50 to be pumped out through a uni-directional valve 56 to the pressure storage 36.

A spill valve 64 is provided between a discharge side line 58 of the pump chamber 54 of the pressure application pump 46 and a withdrawal side line 60 thereof, and is on-off operated according to an electromagnetic actuator 62. The electromagnetic actuator 62, the electromagnetic valve 40 for the three-way electromagnetic valve 34 and an actuator 114 for the booster 100 to be described later are controlled by the controller 200.

The controller 200 controls the electromagnetic actuators 40 and 62 and the booster actuator 114 according to outputs of a cylinder discriminator 68 for discriminating the individual cylinders of multiple cylinder engine, an engine rotation rate/crank angle detector 70, an engine load detector 72 and a fuel pressure sensor 74 for detecting the fuel pressure in the pressure storage 36 as well as, if necessary, such auxiliary information 76 as detected and predetermined signals representing atmospheric temperature and pressure, fuel temperature, etc. affecting the engine operating condition.

Designated at 100 is the booster, at 105 a three-way electromagnetic valve (i.e., second directional control valve for piston operation) for the booster 100, and at 114 an electromagnetic actuator for controlling the three-way electromagnetic valve 105.

The booster 100 includes a boosting piston 101 having a large diameter piston 101*a* and a small diameter piston 101*b* smaller in diameter, a large diameter cylinder 106 in which the large diameter piston 101*a* is inserted, a small diameter cylinder 107 in which the small diameter piston 101*b* is inserted, a large diameter side return spring 104, and a small diameter side return spring 103. The large and small diameter pistons 101*a* and 101*b* may be separate parts, which is more convenient for manufacture.

Designated at 110 is an outlet line (i.e., fuel supply line) of the pressure storage 36. This outlet line 110 branches into three lines, i.e., a line (second line) 111 leading to a first port 105*a* of three-way electromagnetic valve 105 for the booster, a line (first line) 108 communicating with a large diameter fuel chamber (one of division chambers) 125 occupied by the large diameter piston 101*a* of the boosting piston, and a line (fuel supply line) 119 communicating with a small diameter fuel chamber (i.e., first cylinder chamber) 109 occupied by the small diameter piston 101*b*.

Designated at 112 is a line communicating a second port 105*b* of the three-way electromagnetic valve 105 and a middle fuel chamber (the other one of the division chambers) 104 occupied by the back surface of the large diameter piston 101*a*. Designated at 113 is a drain line communicating a third port 105*e* of the three-way electromagnetic valve 105 and the fuel tank 38. Where an operating fluid supply circuit for supplying operating fluid pressure to the booster 100 is provided independently of the high pressure fuel in the pressure storage 36, it is necessary to separately provide an operating fluid tank and a pressure application pump.

An opening 121 of the line 119 to the small fuel chamber 109 is located at a position such that it can be opened and closed by the end face 122 of the small diameter piston 101*b*. In the case of a multi-cylinder engine as in this embodiment, the booster 100 and fuel injection valve 10 are provided for each cylinder, while the pressure storage 36 is common to each cylinder and communicated through an outlet line 40 provided for each cylinder to each booster 100.

The operation of this embodiment of the pressure storage fuel injection system will now be described.

First, when the plunger 50 of the pressure application pump 46 is driven by the eccentric ring or cam 48 which is driven in an interlocked relation to the engine crankshaft, fuel fed under low pressure, fed to the pump chamber 54 by the feed pump 52, is pressurized to a predetermined high pressure before being fed to the pressure storage 36.

According to the engine operating condition, the controller 200 outputs a control signal to the electromagnetic actuator 62 to on-off operate the spill valve 64, which thus controls the fuel pressure in the pressure storage 36 to a predetermined high pressure (for instance 20 to 40 MPa). Meanwhile, a detection signal representing the fuel pressure in the pressure storage 36 is fed back from the sensor 74 to the controller 200.

When the boosting piston 101 is inoperative (i.e., at the left end position), the pressurized fuel in the pressure storage 36 is fed through the fuel line 119 and small diameter fuel chamber 109 and the fuel line 44 to the fuel pool 14 so as to push the needle valve 18 upward, i.e., in an opening direction. When the fuel injection valve 10 is inoperative, the electromagnetic actuator 40 for the three-way electromagnetic valve 34 is held de-energized. In this state, the inlet fuel line a and first outlet fuel line b are in communication with each other, and high pressure fuel in the pressure storage 36 is fed through the uni-directional valve 30 and orifice 32 to the fuel chamber 26.

In this state, the piston 28 in the fuel chamber 26 is held pushed downward by the fuel pressure in the chamber 26, and a valve closing force which is the sum of the push-down force based on the fuel pressure and the spring force of the spring 24 is applied via the push rod 22 to the needle valve 18. The needle valve 18 is thus held in the closed position as illustrated. This is so because the area on which the fuel pressure acts downward against the piston 28 is set to be sufficiently large compared to the area on which the fuel pressure acts upward against the needle valve 18 and further the downward spring force of the spring 24 is acting additionally.

When the electromagnetic actuator 40 is energized subsequently by the control signal of the controller 200, the communication between the inlet fuel line a and the first outlet fuel line b is blocked, and instead the first and second outlet fuel lines b and c are communicated with each other. As a result, the fuel chamber 26 is communicated through the orifice 32 and second outlet fuel line c with the fuel tank 38, thus removing the fuel pressure having been acting on the piston 28. Thus, the spring force of the spring 24 is surpassed by the upward fuel pressure acting on the needle valve 18, thus opening the needle valve 18 to cause high pressure fuel in the fuel pool 14 to be injected through the fuel injection port 12 into the cylinder.

After a predetermined period of time determined according to the engine operating condition, the controller 200 de-energizes the electromagnetic actuator 40 to communicate the inlet and first outlet fuel lines a and b of the three-way electromagnetic valve 34 with each other, thus applying the fuel pressure in the pressure storage 36 to the piston 28. As a result, the needle valve 18 is closed, thus bringing an end to the fuel injection.

Now, the operation of the fuel injection system, using the booster 100 and pressure storage 36 in combination, will be described with reference to FIGS. 2(*a*) to 6(*f*).

In the following description, the three-way electromagnetic valve 34 for fuel injection valve and that 105 for the booster are switched by control signals provided from the controller 200 to the actuators 40 and 114 for the respective electromagnetic valves.

(1) Fuel injection based on sole pressure in pressure storage (FIGS. 2(*a*) to 2(*c*))

In this mode, the fuel lines 111 and 112 are held in communication with each other by the three-way electromagnetic valve 105.

The pressurized fuel in the pressure storage 36 is thus introduced into all of the large, medium and small diameter fuel chambers 125, 126 and 109 of the booster 100, and the boosting piston 101 is held inoperative at the left end position in FIG. 1.

(a) State before fuel injection (FIG. 2(*a*))

In this state, the fuel lines a and b are held in communication with each other by the three-way electromagnetic valve 34. Pressurized fuel is thus led from the small diameter fuel chamber 109 in the booster 100 through the electromagnetic valve 34, orifice 32 and uni-directional valve 30 to the fuel chamber 26 in the fuel injection valve to push the piston 28 against the needle valve 18. The needle valve 18 thus is not opened.

(b) State at commencement of fuel injection (FIG. 2(*b*))

This state is brought about when the fuel lines b and c are communicated with each other by the three-way electromagnetic valve 34. Thus, fuel in the fuel chamber 26 is discharged through the fuel line c to the fuel tank 38 to remove the fuel pressure having been applied to the piston 28.

Meanwhile, pressurized fuel is led to the small diameter fuel chamber 109 of the booster 100 and then fed through the fuel line 44 to the fuel pool 14, thus pushing the needle valve 18 upward to cause fuel injection through the fuel injection port 12 into the cylinder.

(c) State at end of fuel injection (FIG. 2(*c*)) This state is brought about when the fuel lines a and b are communicated with each other by the three-way electromagnetic valve 34. Thus, pressurized fuel is introduced into the fuel chamber 26 to act on the piston 28, thus closing the needle valve 18 to bring about the same state as before the fuel injection shown in FIG. 2(*a*).

Figure 3:
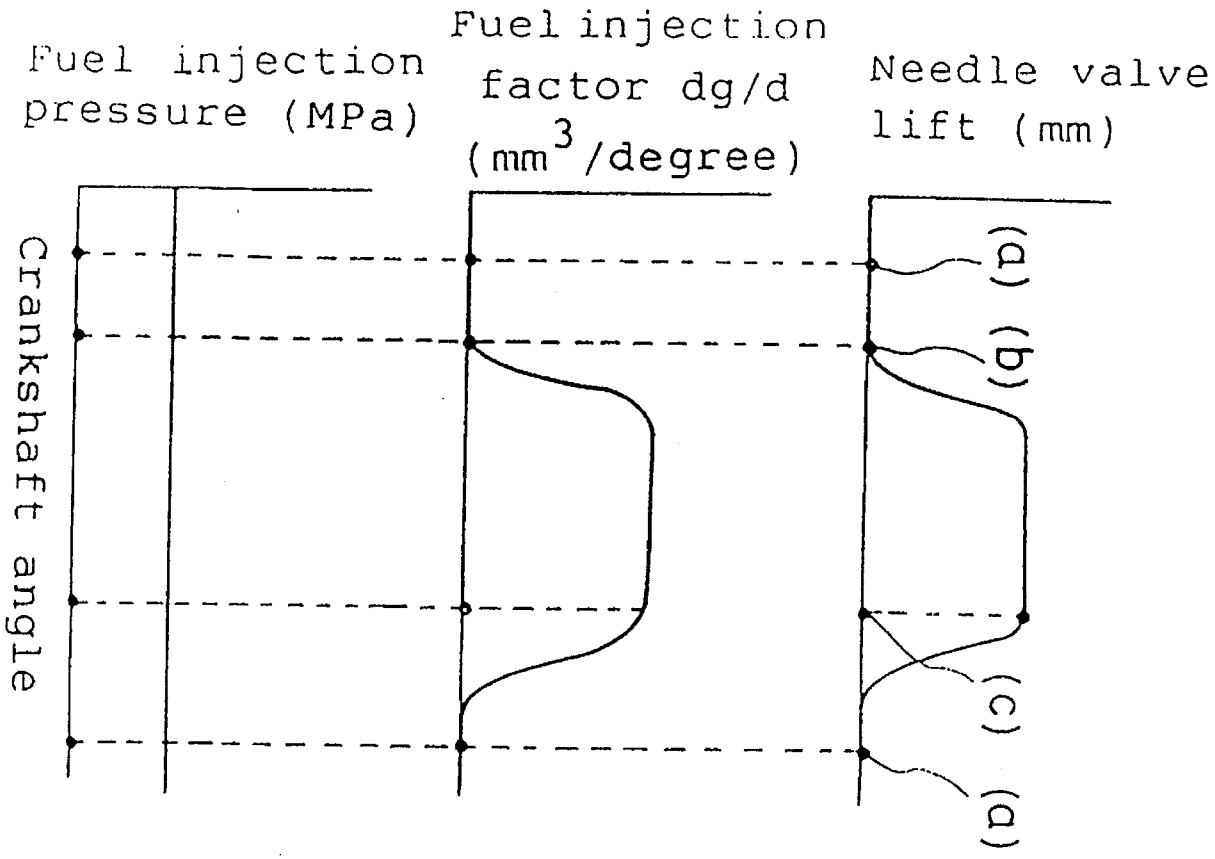
FIG. 3 is shows graphs concerning the fuel injection mode shown in FIGS. 2(*a*) to 2(*c*)
Figure 4A:
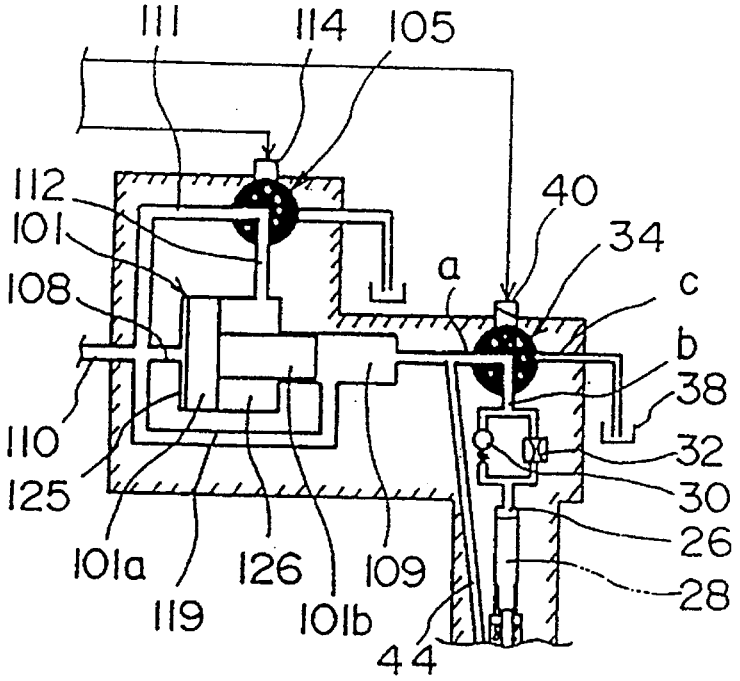
FIGS. 4(*a*) to 4(*d*) are views for explaining operation of fuel injection utilizing a booster, FIG. 4(*a*) showing a state before the fuel injection, FIG. 4(*b*) showing a state in which boosting is in force, FIG. 4(*c*) showing a state at the commencement of the fuel injection, and FIG. 4(*d*) showing a state at the end of the fuel injection.
Figure 4B:
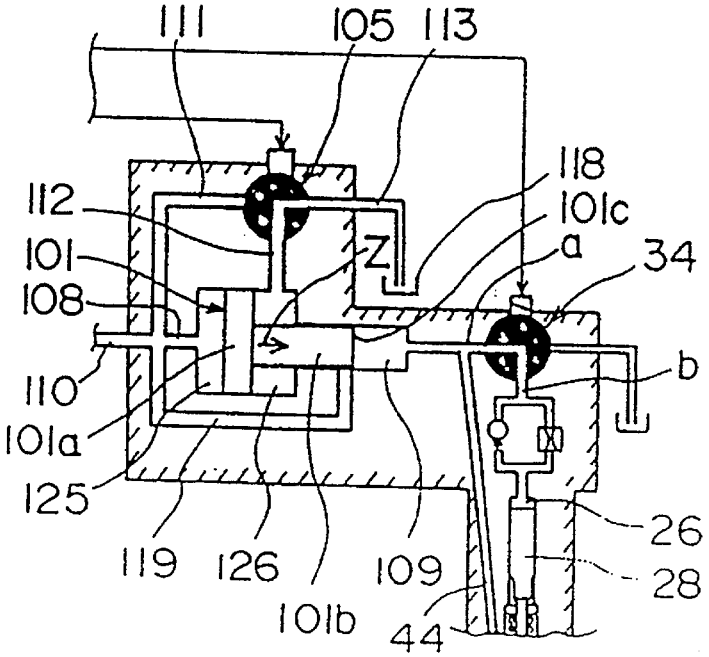
Figure 4C:
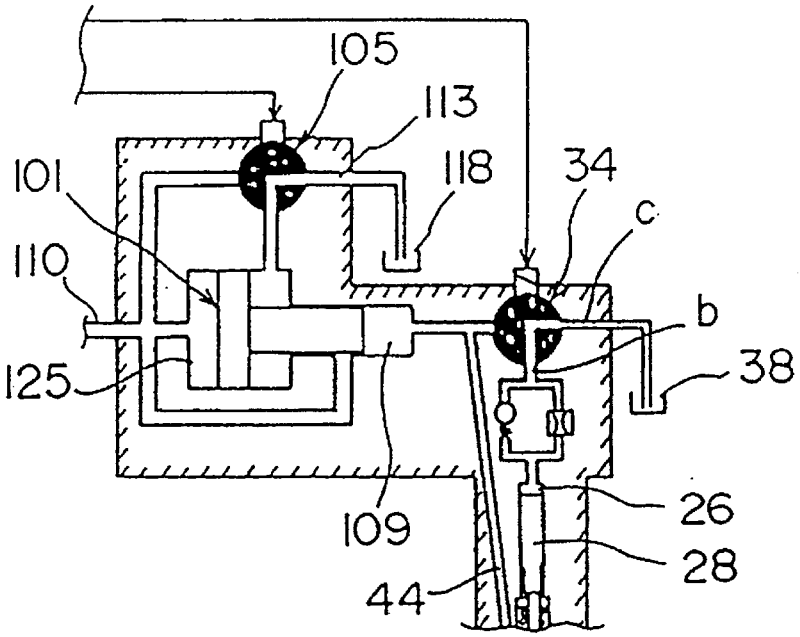
Figure 4D:
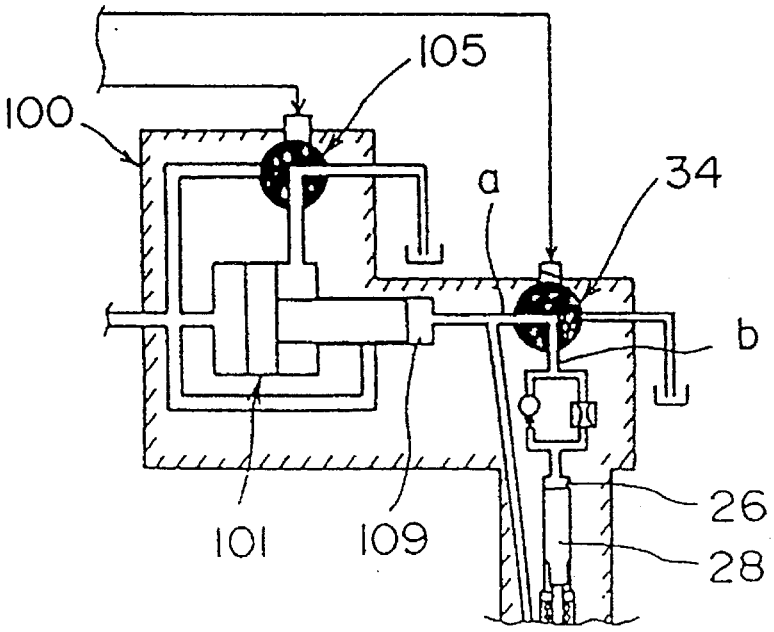

The graphs in FIG. 3 illustrate the fuel injection mode (1) shown in FIGS. 2(*a*) to 2(*c*).

(2) Fuel injection based on sole booster 100 (FIGS. 4(*a*) to 4(*d*))

(a) State before fuel injection (FIG. 4(*a* ))

In this state, the fuel lines 111 and 112 are held in communication with each other by the three-way electromagnetic valve 105. That is, the electromagnetic valve 105 at this time is in the same state as in the above mode (1), and thus the boosting piston 101 is held inoperative.

Also, the fuel lines a and b are held in communication with each other by the three-way electromagnetic valve 34; that is, the electromagnetic valve 34 is in the same state as the state in (a) in the mode (1), and the needle valve 18 is thus held pushed against the valve seat by the piston 28 and closed.

(b) State of boosting by booster (FIG. 4(*b*))

Now, the fuel lines 112 and 113 are communicated with each other by the three-way electromagnetic valve 105, while the fuel lines a and b are communicated with each other by the three-way electromagnetic valve 34.

Pressurized fuel is thus led out from the pressure storage 36 through the fuel lines 110 and 108 to enter the large diameter fuel chamber 125 and act on the large diameter part 101*a* of the boosting piston.

Meanwhile, pressurized fuel in the medium diameter fuel chamber 126 is discharged through the fuel line 112, three-way electromagnetic valve 105 and fuel line 113 to the tank 118, and thus the boosting piston 101 is pushed in the direction of arrow Z, thus closing the fuel line 119 with the end face 101*c* of the small diameter part 101*b* of the piston to pressurize the fuel in the small diameter fuel chamber 109 to a higher pressure.

This increased pressure fuel is led through the fuel line a, the three-way electromagnetic valve 34 and the fuel line b into the fuel chamber 26 so as to push the piston 28, thus holding the needle valve 18 closed.

(c) State at commencement of fuel injection (FIG. 4(*c*))

This state is brought about when the fuel lines b and c are communicated with each other by the three-way electromagnetic valve 34 with the three-way electromagnetic valve 105 held in the same state as in the above state (b). Fuel in the fuel chamber 26 is thus discharged through the fuel line b, electromagnetic valve 34 and fuel line c to the tank 38, and the fuel pressure loaded on the needle valve 18 is released.

Since in the process (b) above the fuel boosted to a higher pressure than the pressure of the high pressure fuel in the pressure storage 36 has been led through the fuel line 44 to the fuel pool 14, it upwardly pushes and opens the needle valve 18 to cause the boosted pressure fuel injection through the fuel injection port 12 into the cylinder.

(d) State after end of fuel injection (FIG. 4(*d*))

This state is brought about when the fuel lines a and b are communicated with each other by the three-way electromagnetic valve 34 with the three-way electromagnetic valve 105 held in the same state as in the above state (c).

Thus, high pressure fuel in the small diameter fuel chamber 109 is introduced into the fuel chamber 26 to act on the piston 28. The needle valve 18 is thus closed by the spring force of the spring 24, thus bringing an end to the fuel injection. After the end of the fuel injection, the controller 200 switches the three-way electromagnetic valve 105 to quickly restore the state (a) so as to be ready for the next fuel injection cycle.

Figure 5:
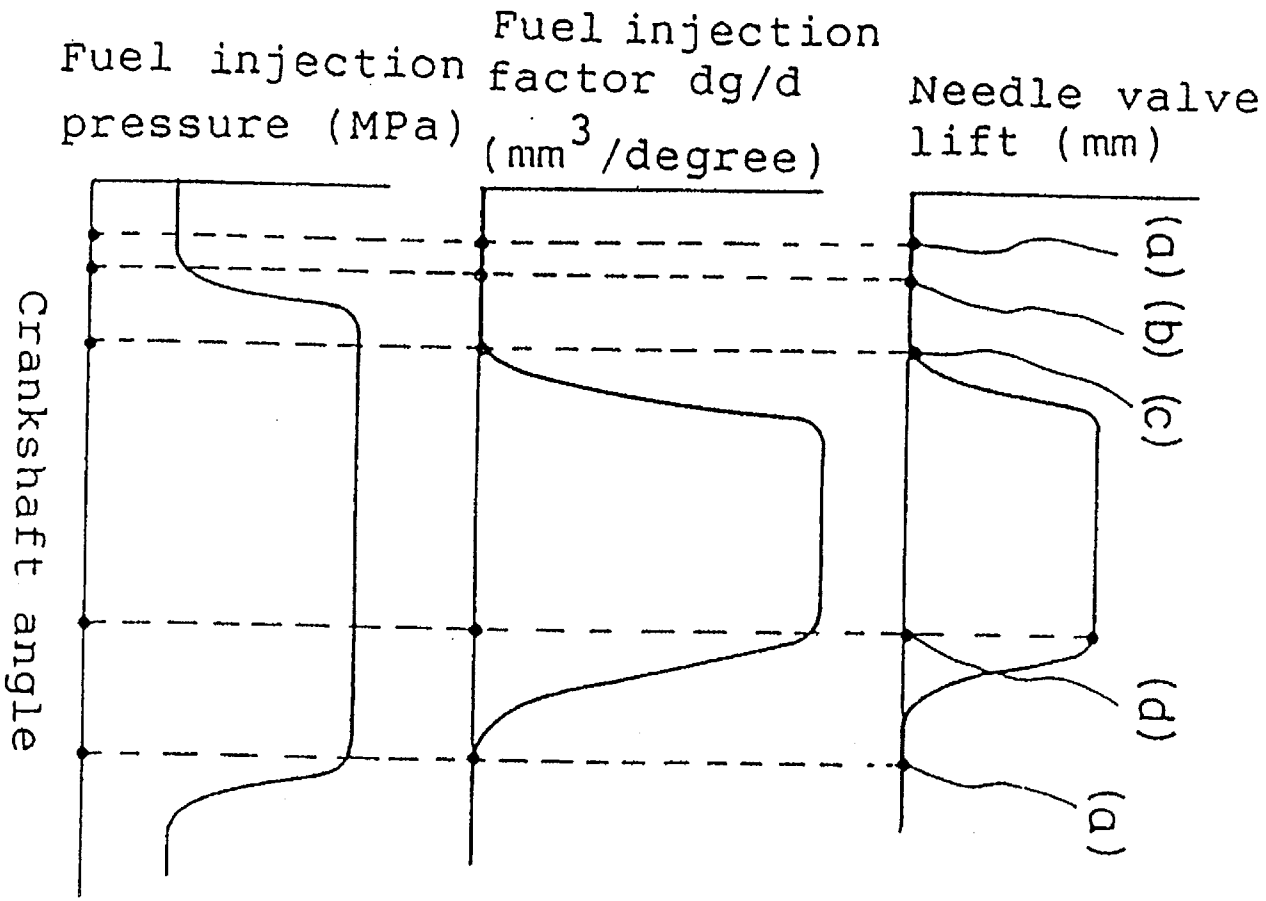
FIG. 5 shows graphs concerning the fuel injection mode shown in FIGS. 4(*a*) to 4(*d*)
Figure 6A:
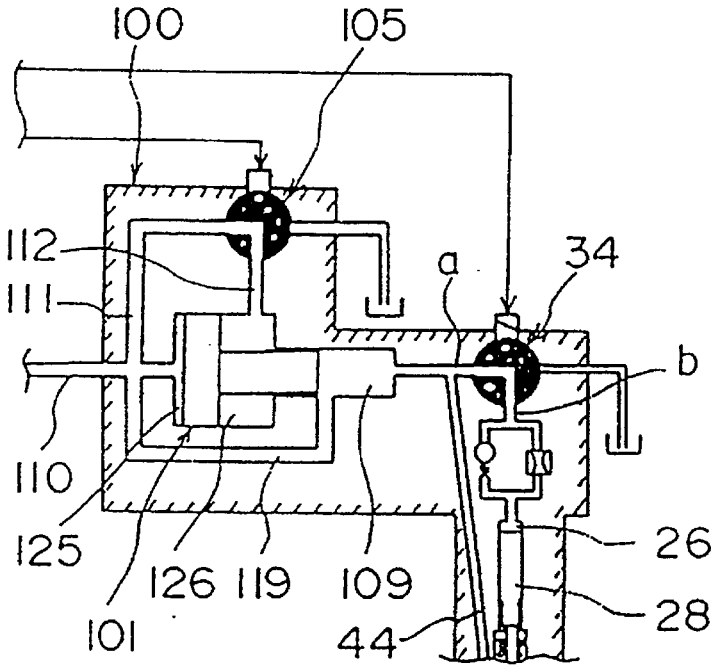
FIGS. 6(*a*) to 6(*f*) are views for explaining operation of pilot fuel injection and main fuel injection with a combination of pressure storage and booster, FIG. 6(*a*) showing a state before the fuel injection, FIG. 6(*b*) showing a state at the commencement of the pilot fuel injection, FIG. 6(*c*) showing a state at the end of the pilot fuel injection, FIG. 6(*d*) showing a state in which boosting is in force, FIG. 6(*e*) showing a state at the commencement of the main fuel injection, and FIG. 6(*f*) showing a state at the end of the fuel injection.
Figure 6B:
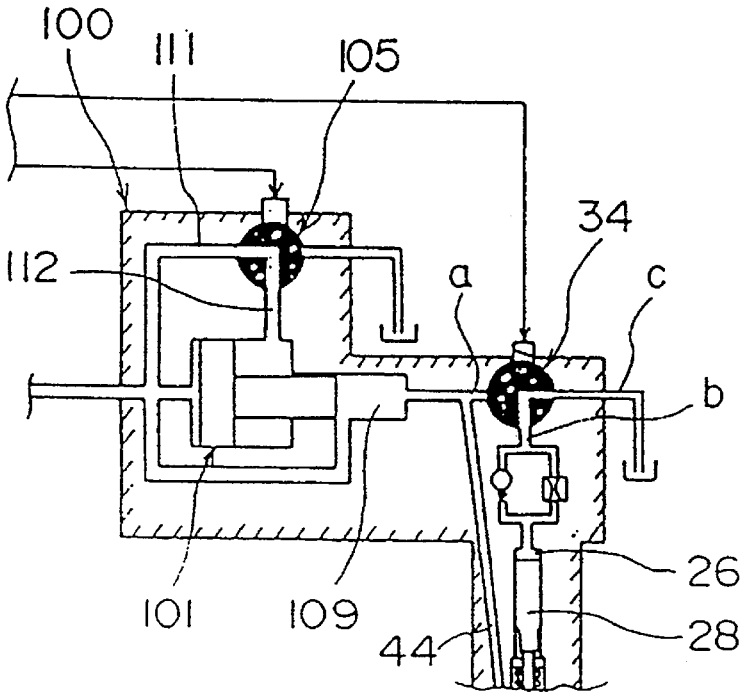
Figure 6C:
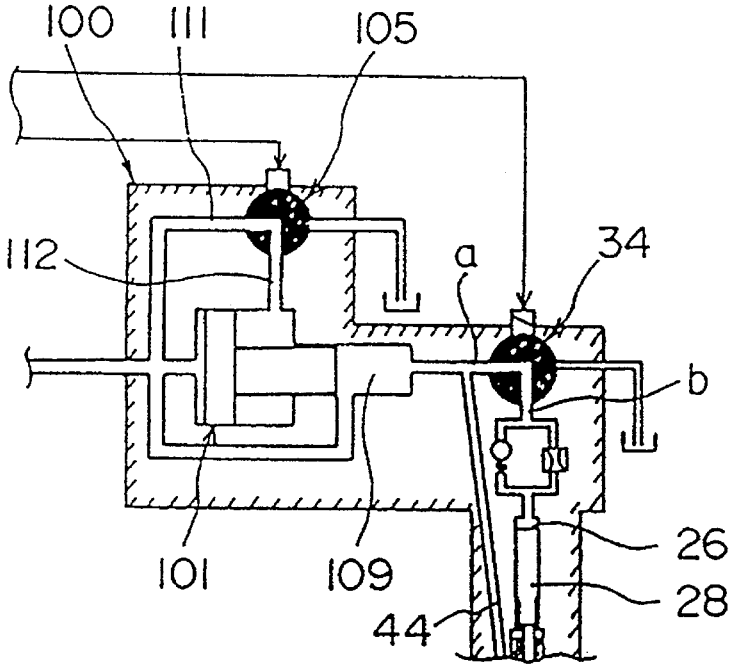
Figure 6D:
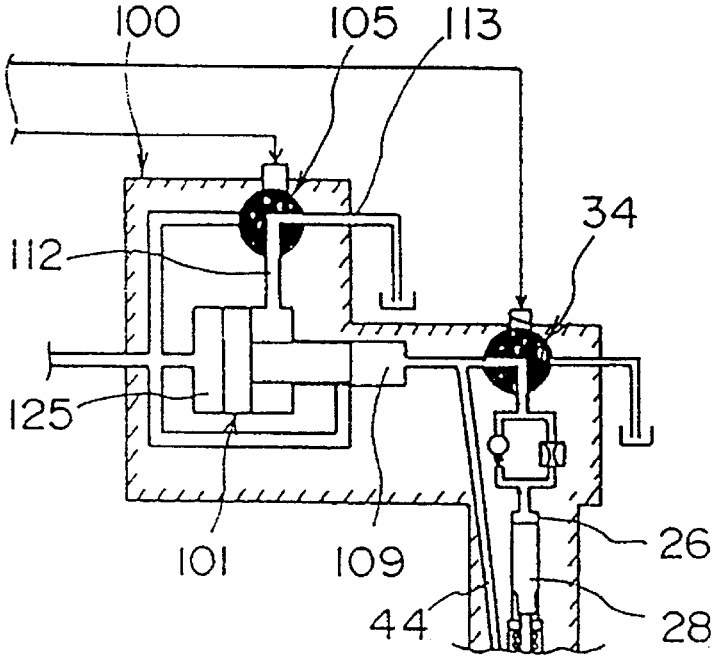
Figure 6E:
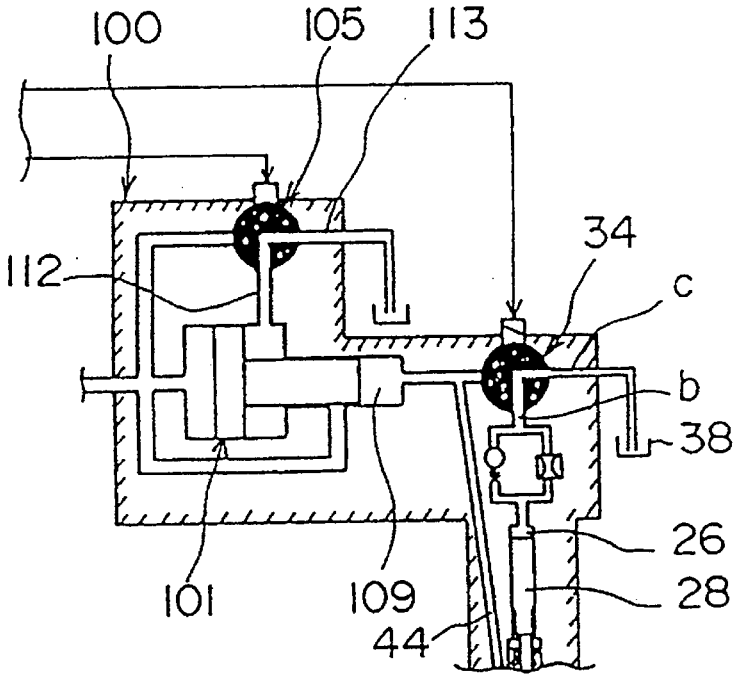
Figure 6F:
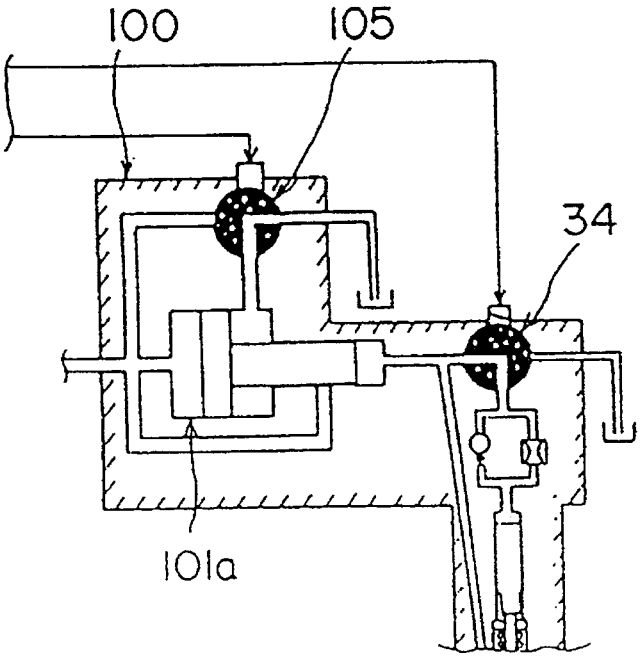

The graphs in FIG. 5 illustrate the fuel injection mode (2) shown in FIGS. 4(*a*) to 4(*d*).

Suitably, fuel injection is controlled such that the fuel injection with the sole pressure in the pressure storage 36 as shown in FIGS. 2(*a*) to 2(*c*) and 3 is utilized for engine operation from idling to low and medium load torque and that the fuel injection by making use of the booster 100 as shown in FIGS. 4(*a*) to 4(*d*) and 5 is utilized for engine operation with medium and high load torque.

Suitably, the pressure in the pressure storage 36 is set to 20 to 40 MPa, preferably 25 to 30 MPa, and the boosting pressure of the booster 100 is set to about 70 to 120 MPa, preferably 70 to 80 MPa.

Figure 12:
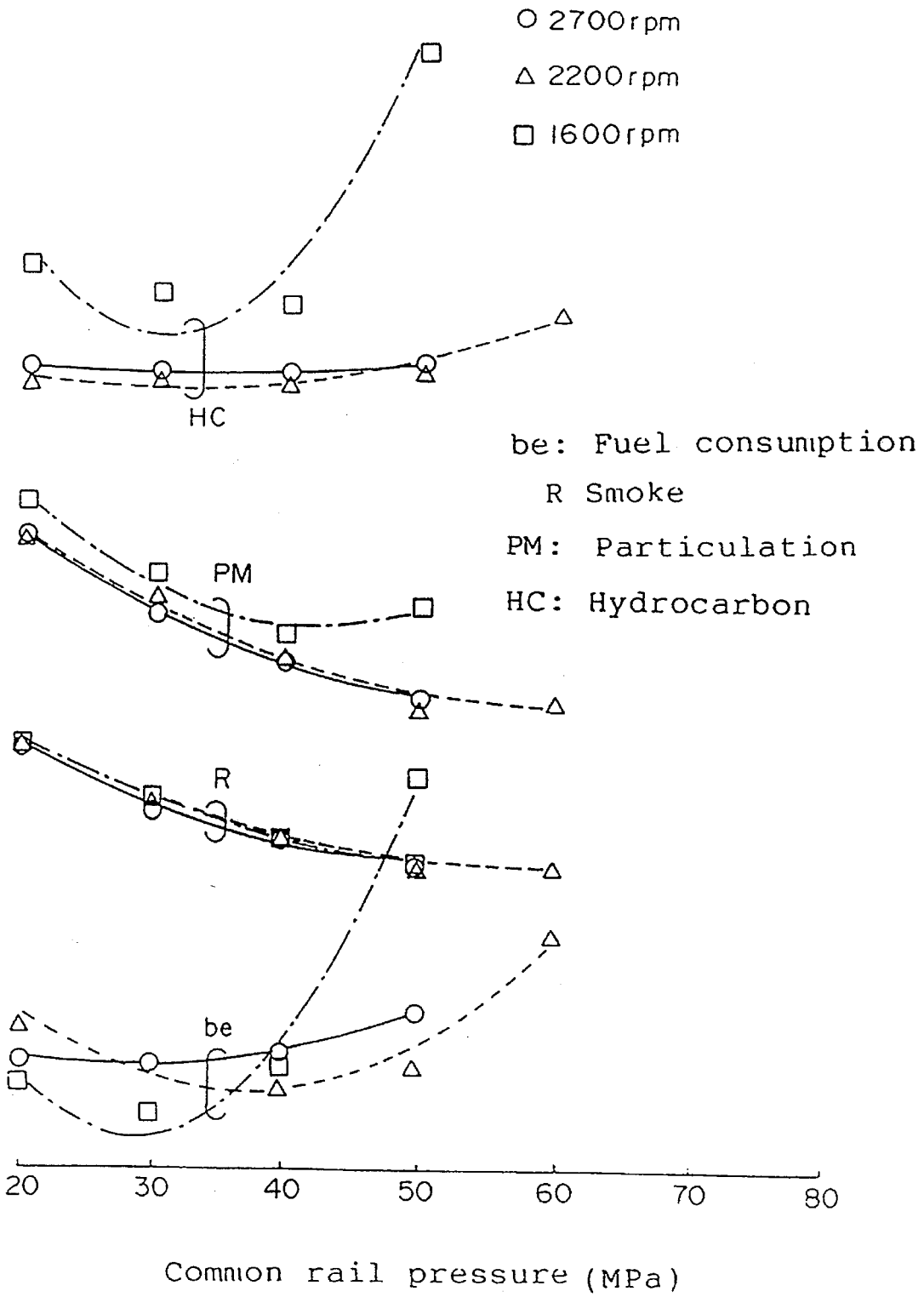
FIG. 12 is a graph showing the relationship among fuel injection pressure (in MPa), fuel consumption be, graphite R, particulation PM and HC when the engine is operated under low and medium speed load conditions.

FIG. 12 shows the relationship among the fuel injection pressure (MPa), fuel consumption rate be, soot R, particulation PM and HC respectively when the engine is operated under 40% load and 100%, about 80% and about 60% of the maximum rotation rate (i.e., 2,700, 2,200 and 1,600 rpm, respectively). It will be seen from the graph that when the engine is operated under low and medium load torque and also 60% of the rotation rate, the fuel injection pressure is suitably set to 20 to 40 MPa, preferably 25 to 30 MPa, that is, it is suitable to set the pressure in the pressure storage 36 in the pressure range noted above.

Figure 13:
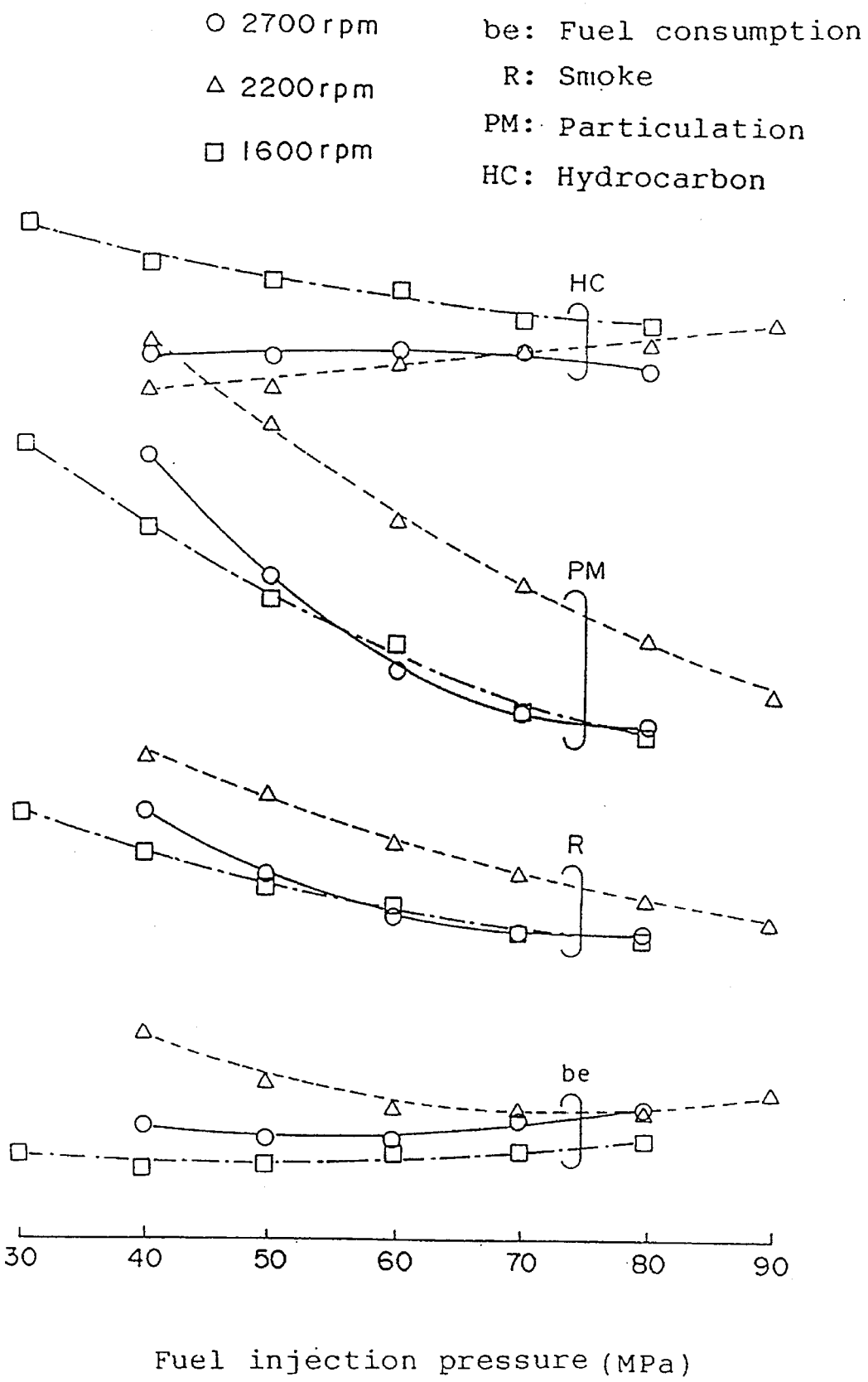
FIG. 13 is a graph showing fuel injection pressure (in MPa), fuel consumption be, graphite R, particulation PM and HC when the engine is operated under high load.
Figure 14:
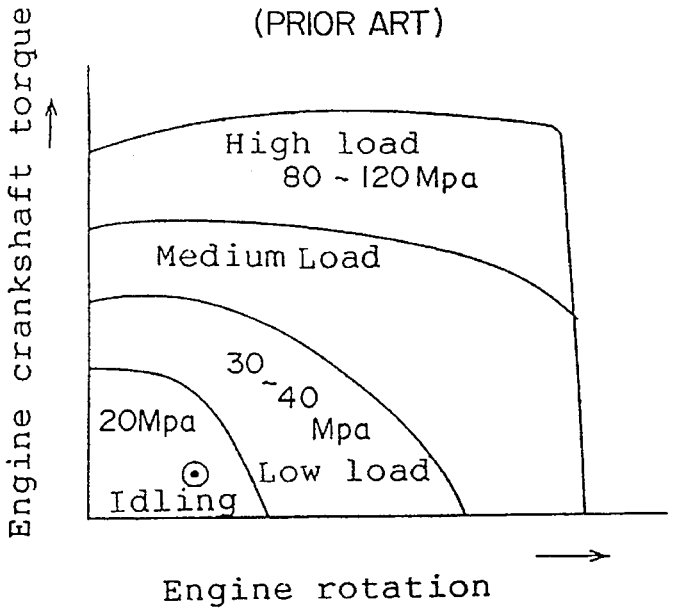
FIG. 14 (PRIOR ART)
FIG. 14 is a graph showing the relationship of pressure storage (common rail) pressure to engine crankshaft torque and engine rotation rate in the prior art pressure storage fuel injection system.

FIG. 13 shows respectively the relationship among the fuel injection pressure (MPa), be, R, PM and HC when the engine is operated under 95% load and 100%, about 80% and about 60% of the maximum rotation rate (i.e., 2,700, 2,200 and 1,600 rpm, respectively). It will be seen from the graph that when the engine is operated under high load torque and also 60% of the rotation rate, the fuel injection pressure is suitably set to 70 MPa or above, specifically about 70 to 120 MPa. However, by excessively increasing the boosting pressure, engine noise is increased proportionally. For this reason, the boosting pressure is suitably set to around 70 to 120 MPa, preferably 70 to 80 MPa.

Figure 11:
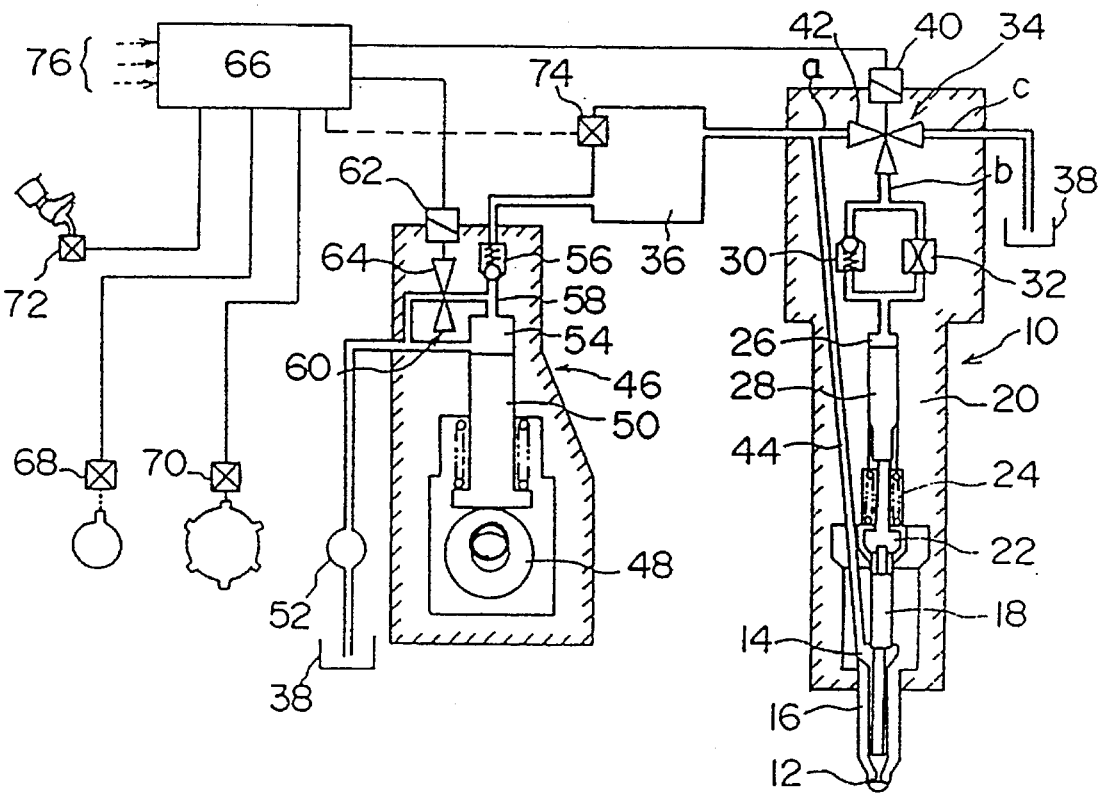
FIG. 11 (PRIOR ART)
FIG. 11 is a schematic representation of a prior art pressure storage fuel injection system.
Figure 15:
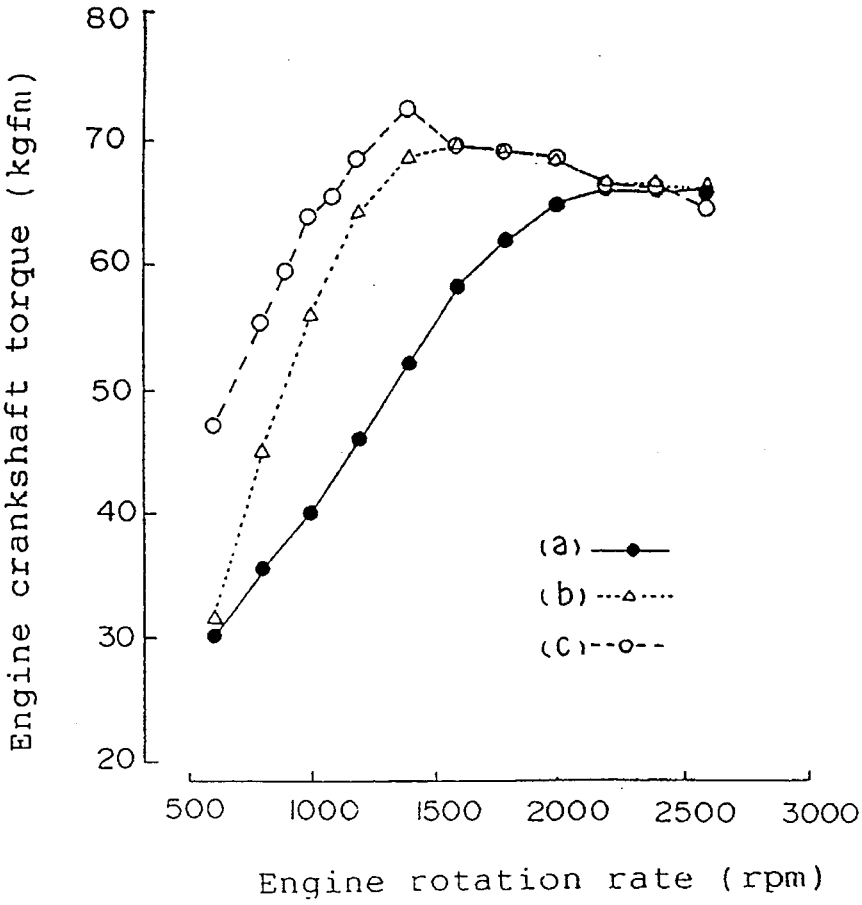
FIG. 15 (PRIOR ART)
FIG. 15 is a graph showing the relation between engine crankshaft torque and engine rotation rate, plot (a) representing the relation obtained with the prior art pressure storage fuel injection system, plot (b) representing the relation obtained with a prior art row type fuel injection pump, plot (c) representing the relation obtained with the pressure storage fuel injection system according to the invention.

Further, in this embodiment, unlike the pressure storage fuel injection system shown in FIG. 11 described before, there is no need of greatly increasing the pressure storage (common rail) pressure. Thus, even when quickly increasing pressure from low pressure fuel injection (with fuel injection pressure of 20 MPa) under low load to high pressure fuel injection (with fuel injection pressure of 90 MPa) under high load, it is possible to quickly raise the fuel injection pressure as shown by plot (c) in FIG. 15, and there is no possibility of engine output shortage and a delay of engine rotation rate under a transient engine operating condition such as quickly accelerating the vehicle.

Figure 16:
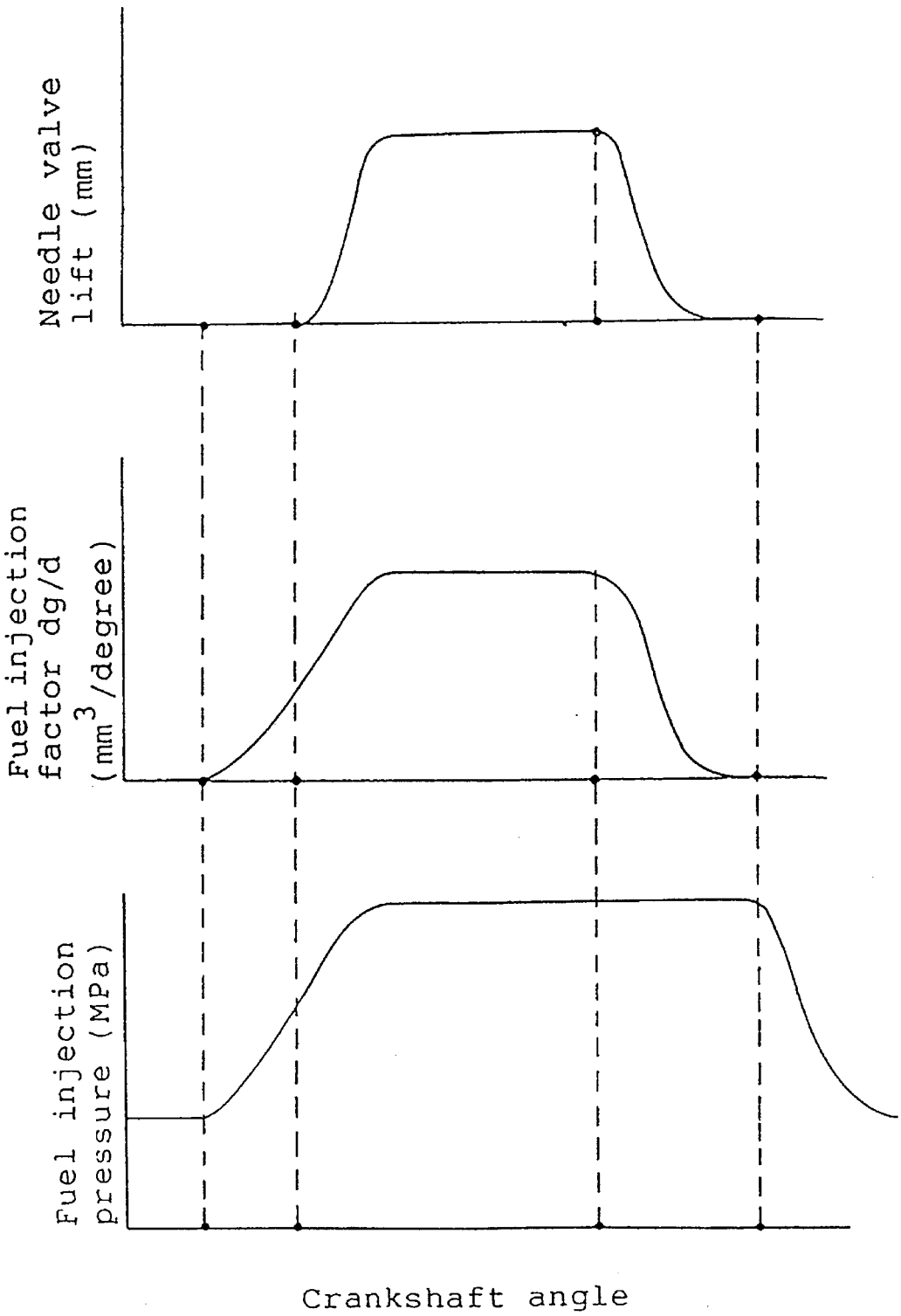
FIG. 16 shows graphs concerning a fuel injection mode, in which optimum fuel injection rate control for combustion can be obtained while suppressing initial stage main fuel injection under low or medium load through control of the valve opening timing or valve opening of a three-way electromagnetic valve with a controller.

Further, as shown in FIG. 16, the controller 200 may control the opening timing and opening degree of the three-way electromagnetic control valve 105 with a combination of the fuel injection modes shown in FIGS. 3 and 5. In this case, it is possible to reduce the fuel injection rate through control of the lift timing of the needle valve. This may be done when it is desired to have the initial pressure in the main fuel injection be slightly higher than the pressure storage pressure. In other words, under low or medium load engine operation, optimum fuel injection rate control for the combustion can be obtained while suppressing the initial state main fuel injection.

Not only with this embodiment of the pressure storage fuel injection system but also with the general pressure storage fuel injection system, the engine noise is greatly increased compared to the case of the prior art row type fuel injection pump.

To obviate this drawback, according to the invention, an operation commonly called pilot fuel injection, in which the needle valve 18 is slightly shifted, is made prior to main fuel injection under a low speed engine operating condition for reducing noise. (In this case, fuel injection is made twice, i.e. the pilot fuel injection and main fuel injection, in one combustion cycle.)

Now, the function of the embodiment obtainable when the pilot fuel injection is made in combination will be described.

(3) Pilot fuel injection with pressure storage pressure and main fuel injection with booster (FIGS. 6(*a*) to 6(*d*))

(a) State before fuel injection (FIG. 6(*a*))

In this state, the fuel lines 111 and 112 are held in communication with each other by the three-way electromagnetic valve 105, and also the fuel lines a and b are held in communication with each other by the three-way electromagnetic valve 34.

This state is the same as the state before the fuel injection in the above modes (1) and (2).

(b) State at commencement of pilot fuel injection (FIG. 6(*b*))

The three-way electromagnetic valve 34 is switched to communicate the fuel lines b and c with each other with the fuel lines 111 and 112 held in communication with each other by the three-way electromagnetic valve 105 as in the state (a) above. This state is the same as the state (b) at the commencement of the fuel injection with the booster 36 in the above case (1), and pressurized fuel from the pressure storage 36 is led through the small diameter fuel chamber 109 in the booster 100, fuel line 44 and fuel pool 14 to be injected through the fuel injection port 12 into the cylinder.

(c) State at the end of the pilot fuel injection (FIG. 6(*c*))

At this moment, like the states (a) and (b) above, the fuel lines 111 and 112 are held in communication with each other by the three-way electromagnetic valve 105. This state is brought about when the three-way electromagnetic valve 34 is switched to communicate the fuel lines a and b with each other.

This state is the same as the state (c) in the mode (1), and thus pressurized fuel is introduced at this time into the fuel chamber 26 to push the piston 28 to close the needle valve 18, thus bringing an end to the pilot fuel injection.

(d) State of boosting with booster (FIG. 6(*d*))

In this state, the fuel lines 112 and 113 are held in communication with each other by the three-way electromagnetic valve 105, while the fuel lines a and b are held in communication with each other by the three-way electromagnetic valve 34.

This state is the same as the state (b) in the mode (1). Thus, fuel which has been boosted to a higher pressure by the boosting piston 101 is led to the fuel pool 14 in the fuel injection valve, so that the needle valve 18 is pushed against the valve seat and held closed by the pressure application piston 26.

(e) State at commencement of main fuel injection (FIG. 6(*e*))

At this time, the fuel lines 112 and 113 are communicated with each other by the three-way electromagnetic valve 105, and the fuel lines b and c are communicated with each other by the three-way electromagnetic valve 34.

This state is the same as the state (c) in the mode (2), and fuel in the fuel chamber 26 in the fuel injection valve is discharged to the tank 38 to open the needle valve 18, whereupon fuel having been boosted by the booster 100 to be higher in pressure than the high pressure fuel in the pressure storage 36 is injected through the fuel injection port 12 into the cylinder.

(f) State at end of main fuel injection (FIG. 6(*f*))

This state is brought about when the three-way electromagnetic valve 34 is switched to communicate the fuel lines a and b with each other with the three-way electromagnetic valve 105 held in the same state as in the above state (e).

This state is the same as the state (d) in the mode (2), and boosted pressure fuel from the booster 100 is introduced into the fuel chamber 26 in the fuel injection valve to act on the piston 28, thus opening the needle valve 18.

Figure 7:
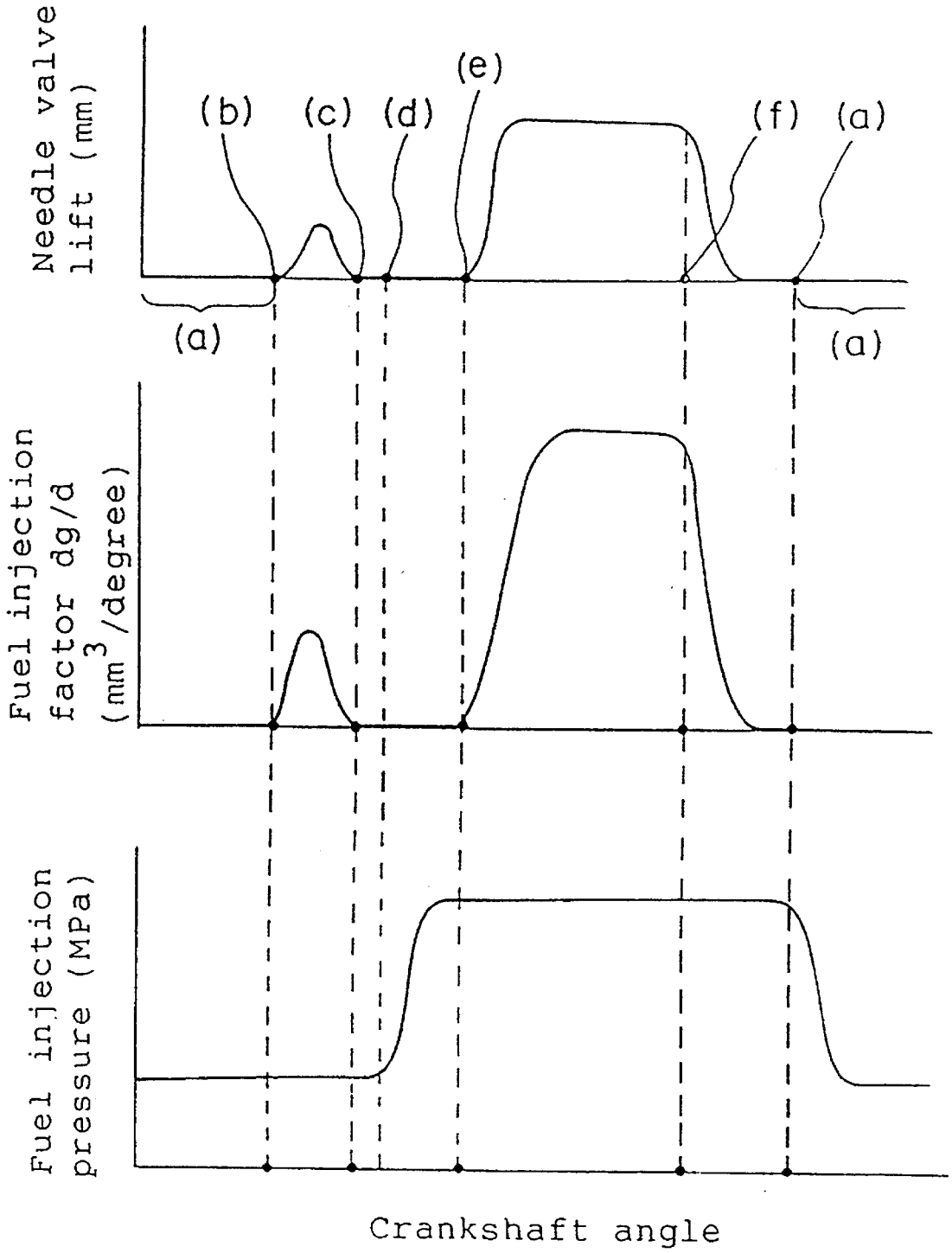
FIG. 7 shows graphs concerning the fuel injection mode shown in FIGS. 6(*a*) to 6(*f*)
Figure 8A:
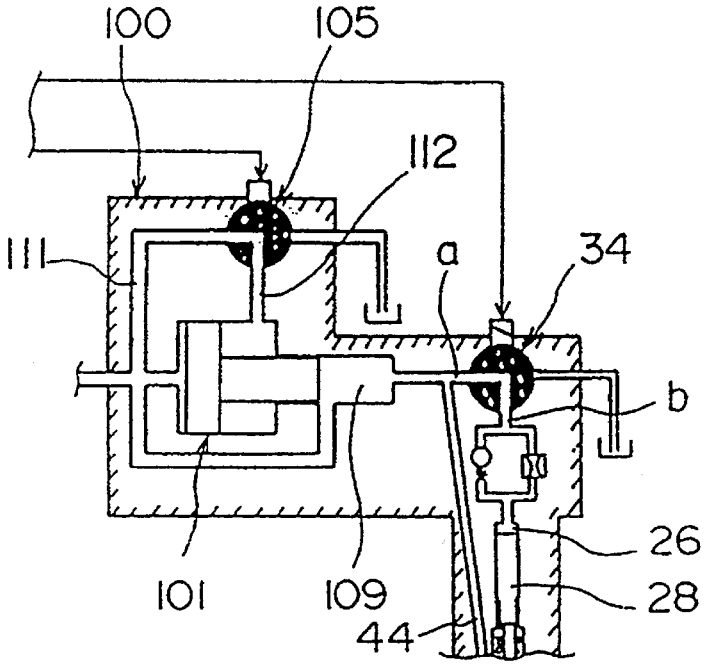
FIGS. 8(*a*) to 8(*f*) are views for explaining of operation of pilot fuel injection and main fuel injection both brought about with the sole pressure storage, FIG. 8(*a*) showing a state before the fuel injection, FIG. 8(*b*) showing a state at the commencement of the pilot fuel injection, FIG. 8(*c*) showing a state at the end of the pilot fuel injection, FIG. 8(*d*) showing a state before the main fuel injection, FIG. 8(*e*) showing a state in which the main fuel injection is in force, and FIG. 8(*f*) showing a state at the end of the main injection.
Figure 8B:
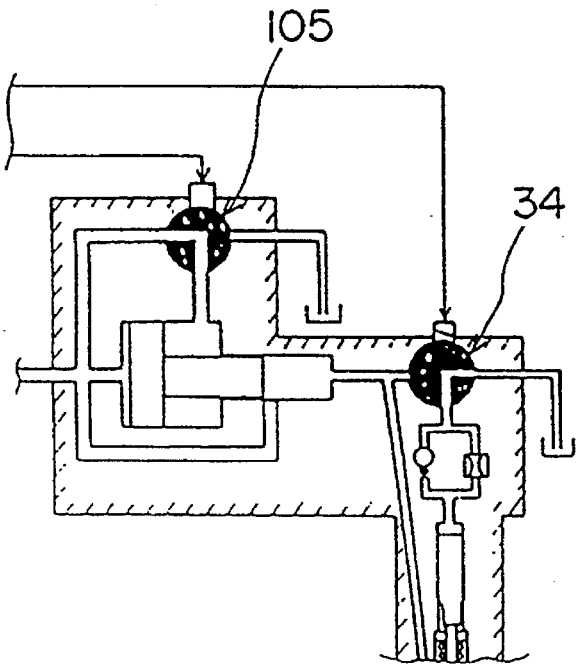
Figure 8C:
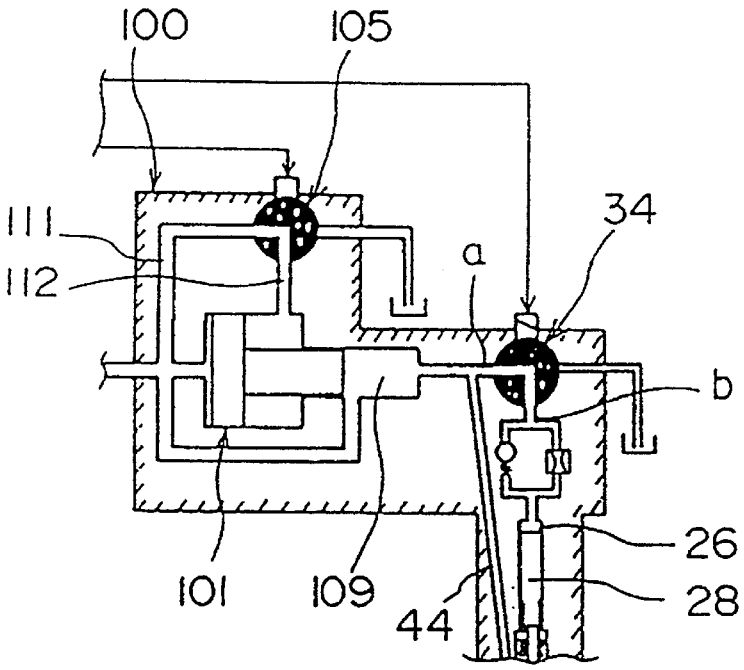
Figure 8D:
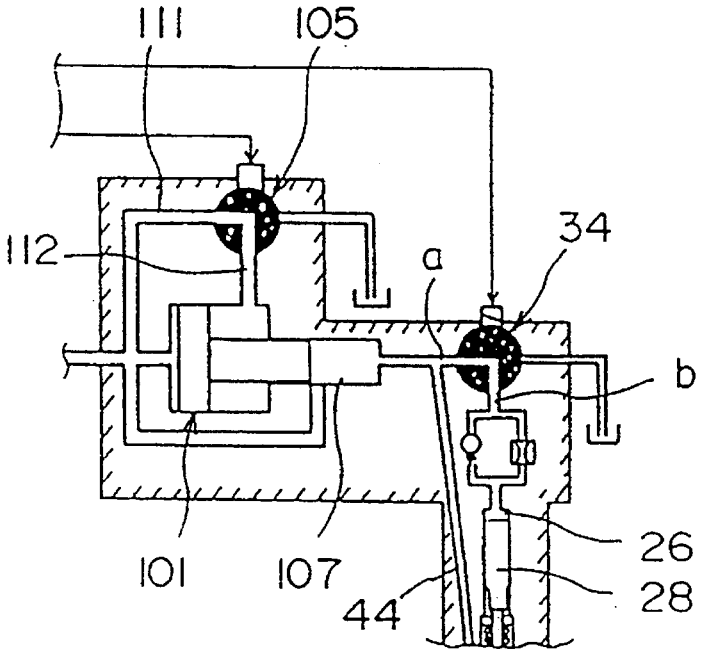
Figure 8E:
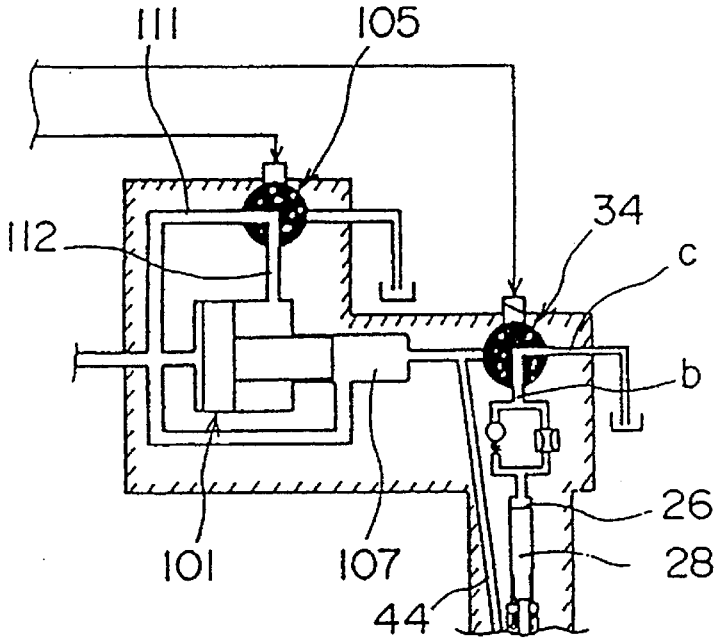
Figure 8F:
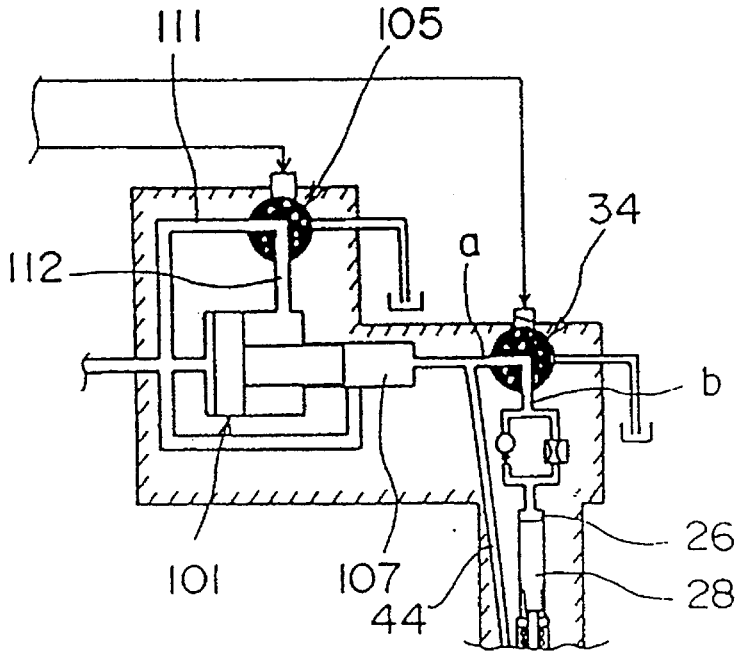

The graphs in FIG. 7 illustrate the fuel injection mode with the combination of the pilot fuel injection with the pressure storage 36 and the boosted pressure main fuel injection with the booster 100 as described before in connection with FIGS. 6(*a*) to 6(*f*).

Referring to this Figure, the pilot fuel injection with the booster 100 is made for a period from point (b) to point (c), and the boosted pressure main fuel injection with the booster 100 is made for a period from point (e) to (f).

(4) Pilot fuel injection based on sole booster and main fuel injection (FIGS. 8(*a*) to 8(*f*))

In this case, like the above case (1), the fuel lines 111 and 112 are held in communication with each other by the three-way electromagnetic valve 105 to hold the booster 100 inoperative.

(a) State before fuel injection (FIG. 8(*a*))

This state is the same as the state (a) in the mode (1), with the fuel lines a and b held in communication with each other by the three-way electromagnetic valve 34 so that the needle valve 18 is held closed by the pushing force of the piston 28.

(b) State at commencement of pilot fuel injection (FIG. 8(*b*)) This state is the same as the state (b) in the mode (1). This state is brought about when the fuel lines b and c are communicated with each other by the three-way electromagnetic valve 34. Thus, fuel pressure acting on the piston 28 is released to open the needle valve 18, thus causing fuel injection from the pressure storage 36 into the cylinder.

(c) State at end of pilot fuel injection (FIG. 8(*c*))

This state is the same as the state (c) in the mode (1). This state is brought about when the fuel lines a and b are communicated with each other by the three-way electromagnetic valve 34. Pressurized fuel from the pressure storage 36 is thus caused to act on the piston 28 so as to close the needle valve 18.

Subsequently, the main fuel injection based on the sole pressure storage 36 is brought about in the sequence of (d) to (f) described below. This sequence is the same as in the pilot fuel injection in (a) to (c) described above.

In this case, however, the controller 200 controls the amount of fuel injected and period of fuel injection to be greater and longer than those in the pilot fuel injection.

(d) State before main fuel injection (FIG. 8(*d*))

In this state, the fuel lines a and b are held in communication with each other by the three-way electromagnetic valve 34 to hold the needle valve 18 closed.

(e) State of main fuel injection (FIG. 8(*e*))

This state is brought about when the fuel lines b and c are communicated with each other by the three-way electromagnetic valve 34 to open the needle valve 18, thus causing fuel injection from the pressure storage 36.

(f) State at end of main fuel injection (FIG. 8(*f*))

This state is brought about when the fuel lines a and b are communicated with each other by the three-way electromagnetic valve 34 to close the needle valve 18.

Figure 9:
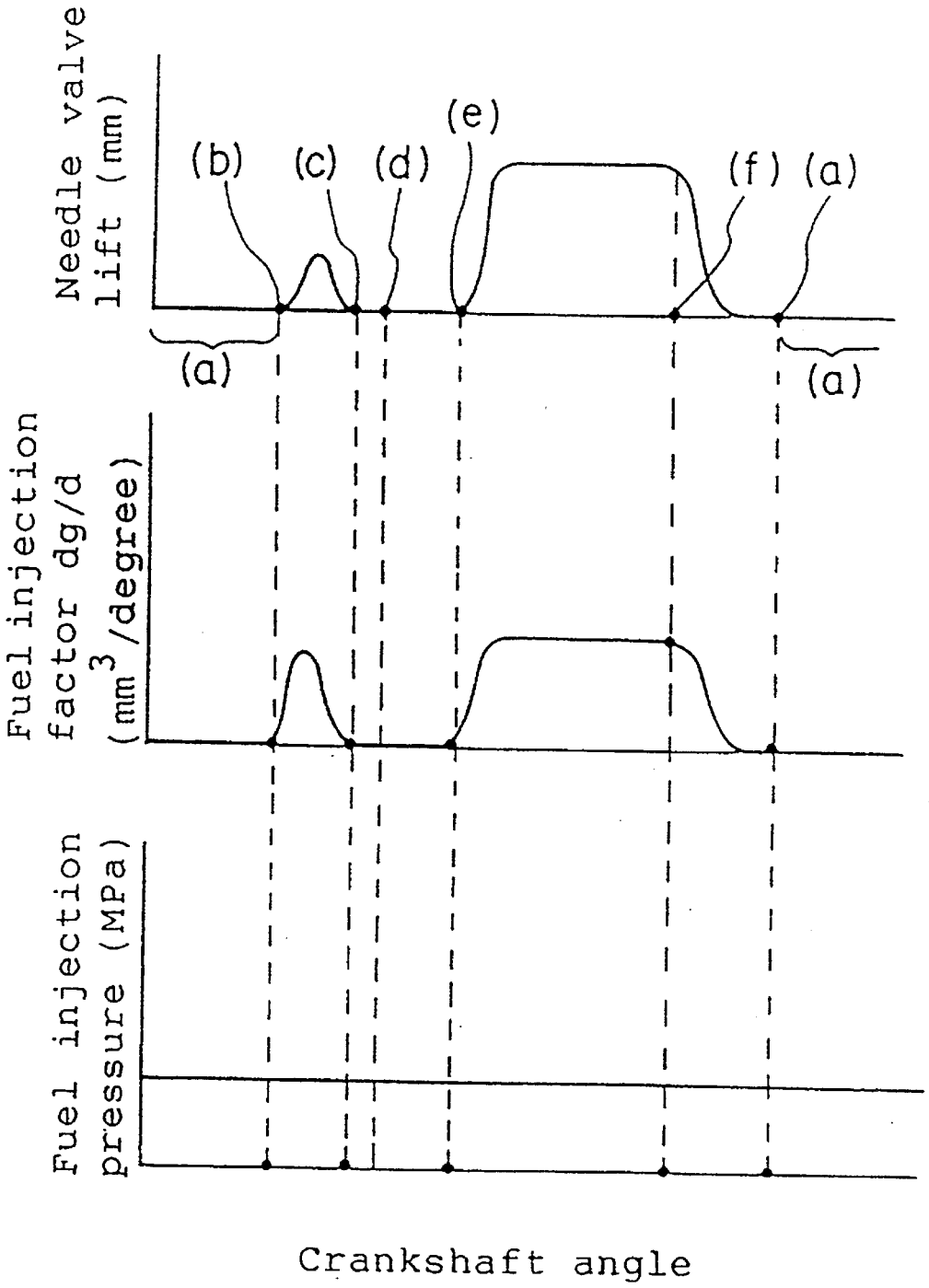
FIG. 9 shows graphs concerning the fuel injection mode shown in FIGS. 8(*a*) to 8(*f*)

The graphs in FIG. 9 illustrate the fuel injection mode with the combination of the pilot fuel injection with the sole pressure storage pressure and the main fuel injection in (a) to (f) as described above.

The controller 200 switches the modes of fuel injection in the modes (1) to (4) described above over to one another in accordance with the engine operating condition.

Specifically, during idling and under low load the fuel injection mode (1) or (4) is selected, that is, low pressure fuel injection with the sole pressure of the pressure storage 36 is made. Under a predetermined high load and above, the booster 100 is operated for engine operation control, that is, making fuel injection in the mode (3). In other words, the fuel injection is made as the combination of the initial stage low pressure pilot fuel injection and the high pressure main fuel injection.

With the above fuel injection system, the three-way electromagnetic valve permits momentary switching of low pressure fuel injection based on the pressure storage pressure over to the high pressure fuel injection making use of the booster. It is thus possible to greatly improve the response under a transient engine operating condition.

Further, by combining the low pressure pilot fuel injection and the high pressure fuel injection making use of the booster, it is possible to greatly reduce the engine noise level.

Figure 10:
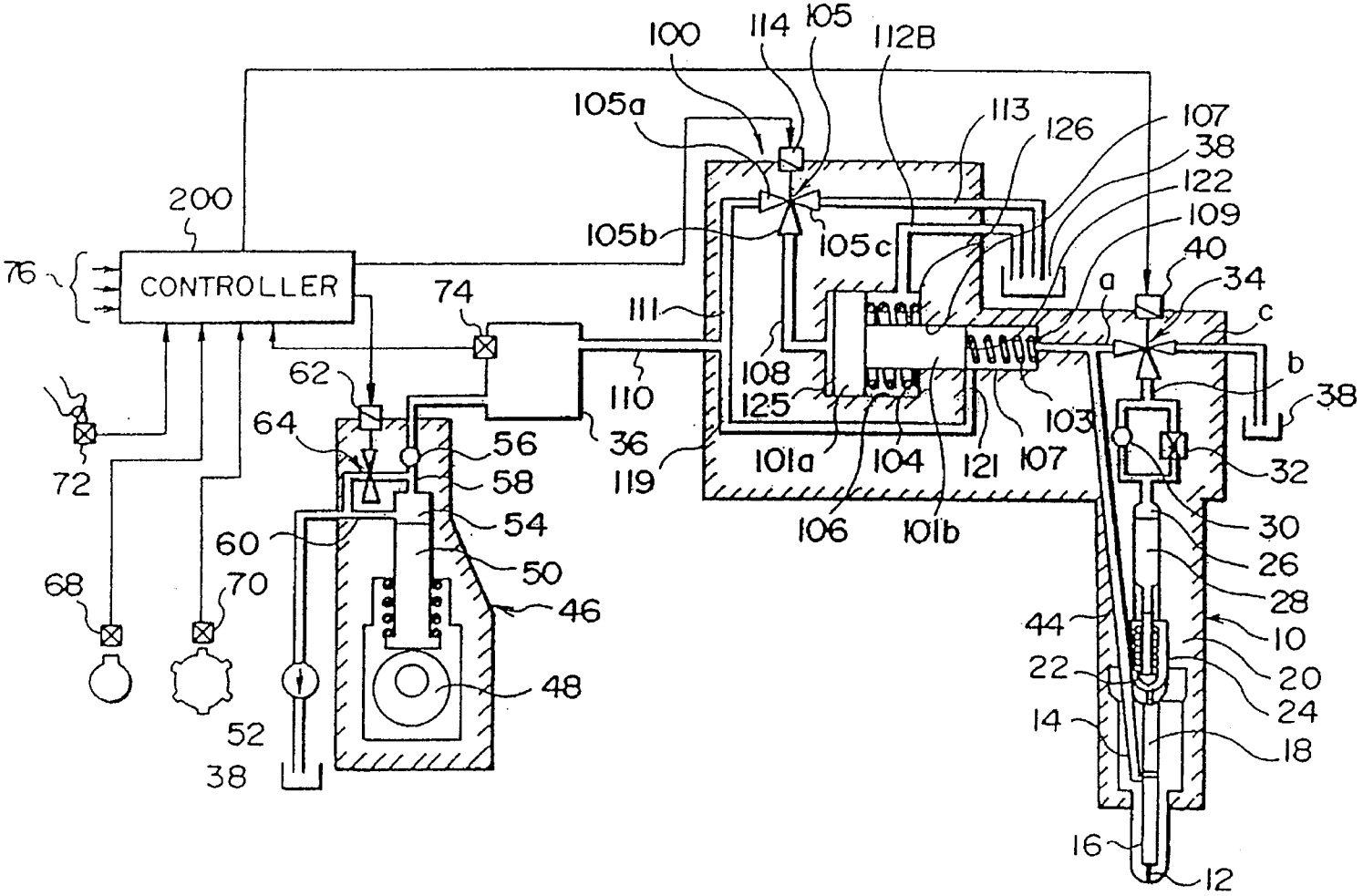
FIG. 10 is a schematic representation of a different embodiment of the pressure storage fuel injection system according to the invention.

FIG. 10 is a schematic representation of a different embodiment of the pressure storage fuel injection system according to the invention.

This embodiment will be described mainly in connection with its difference from the preceding embodiment shown in FIG. 1. Reference numeral 100 designates a booster, 105 a three-way electromagnetic valve for the booster (i.e., second directional control valve for piston operation), and 114 an electromagnetic actuator for controlling the three-way electromagnetic valve 105.

The booster 100, like that in the embodiment of FIG. 1, includes a boosting piston 101 having a large diameter piston 101*a* and a small diameter piston 101*b* which is smaller than the large diameter piston 101*a* as one body, a large diameter cylinder 106 in which the large diameter piston 101*a* is inserted, a small diameter cylinder 107 in which the small diameter piston 101*b* is inserted, a large diameter side return spring 104, and a small diameter side return spring 103.

Reference numeral 110 designates an outlet fuel line (fuel feeding line) of a pressure storage 36. This fuel line 110 is different from that in the previous embodiment in that it is branched into two fuel lines, i.e., a fuel line (second fuel line) 111 leading to a first port 105*a* of the three-way electromagnetic valve 105 for the booster and a fuel line (fuel feeding line) 119 communicated with a small diameter fuel chamber (first cylinder chamber) 109 defined by the small diameter piston 101*b* of the boosting piston 101. Unlike the previous embodiment, the outlet fuel line 110 is not communicated with the first fuel line 108 which is communicated with the large diameter fuel chamber (one of sub-chambers) 125 defined by the large diameter part 101*a* of the boosting piston 101.

The first fuel line 108 is independently communicated with the second port 105*b* of the three-way electromagnetic valve 105.

A fuel line (i.e., third fuel line) 112B which is communicated with a medium diameter fuel chamber (i.e., other sub-chamber) 126 defined by the back of the large diameter part 101*a* of the boosting piston 101, unlike the previous embodiment, is not communicated with the second port 105*b* of the three-way electromagnetic valve 105 but is communicated with a fuel tank 38, that is, open to atmosphere.

With this structure, by bringing about communication between the first and second ports 105*a* and 105*b* of the three-way electromagnetic valve 105, i.e., communication between the outlet fuel line 110 of the pressure storage 36 and the first fuel line 108, thus leading the fuel pressure in the pressure storage 36 to the large diameter fuel chamber 125, the large diameter piston 101*a* of the boosting piston 101 is moved, that is, the boosting piston 101 is operated, thus obtaining the boosting of the fuel pressure.

In addition, by switching the three-way electromagnetic valve 105 to communicate the second port 105*b* and the fuel draining line 113, the pressure in the large diameter fuel chamber 125 can be removed to the fuel tank side. Further, since the medium diameter fuel chamber (i.e., other sub-chamber) 126 which is located on the opposite side of the large diameter part 101*a* of the boosting piston 101 is communicated through the third fuel line 112B with the fuel tank 38, i.e., open to atmosphere, the movement of the large diameter part 101*a* can be prohibited to render the boosting piston 101 inoperative.

Thus, with this embodiment the same effects as in the previous embodiment are obtainable.

What is claimed is:

1. A pressure storage fuel injection system comprising:

fuel feeding means for feeding fuel of a predetermined pressure;

a pressure storage for storing fuel fed out from the fuel feeding means in a pressurized state;

a fuel feeding line for feeding fuel from the pressure storage to a fuel pool provided in a fuel injection valve for fuel to be injected;

a fuel control line branching from the fuel feeding line and leading to a fuel chamber formed for needle valve on-off control in the fuel injection valve;

a first directional control valve provided for fuel injection control in the fuel control line, the first directional control valve being operable to apply a fuel pressure to the fuel chamber so as to close the needle valve in the fuel injection valve and cease application of the fuel pressure to the fuel chamber so as to open the needle valve;

a first cylinder chamber formed in the fuel feeding line;

a boosting piston provided in the first cylinder chamber and operable for reducing a volume of the first cylinder chamber so as to boost the fuel pressure on the downstream side of the first cylinder chamber;

a fuel supply circuit for supplying fuel from said pressure storage to said fuel feeding line and to the boosting piston;

a second directional control valve provided for operating the boosting piston in the fuel supply circuit and operable to on-off switch application of fuel pressure to the boosting piston, thus driving the boosting piston; and a controller for providing control signals to the first directional control valve for the fuel injection control and the second directional control valve for operating the boosting piston to control the on-off control of the needle valve and operation of the boosting piston.

2. The pressure storage fuel injection system according to claim 1, wherein the controller outputs control signals to the first and second directional control valves to switch a high pressure fuel injection mode corresponding to an operative state of the boosting piston and a low pressure fuel injection mode corresponding to an inoperative state of the boosting piston.

3. The pressure storage fuel injection system according to claim 2, wherein the controller detects at least an engine load as an engine operating condition and causes the low pressure fuel injection mode under a low load engine operating condition and the high pressure fuel injection mode under a high load engine operating condition.

4. The pressure storage fuel injection system according to claim 2, wherein the controller controls fuel injection by switching the fuel injection pressure such that small amount fuel injection corresponding to pilot fuel injection and large amount fuel injection corresponding to main fuel injection are made in one combustion cycle.

5. The pressure storage fuel injection system according to claim 4, wherein the controller causes the small amount fuel injection corresponding to pilot fuel injection in the low pressure fuel injection mode and the subsequent large amount fuel injection corresponding to main fuel injection in accordance with the engine operating condition, the low pressure fuel injection mode being caused under a low load engine operating condition, the high pressure fuel injection mode being caused under a high load engine operating condition.

6. The pressure storage fuel injection system according to claim 2, wherein a boosting piston is provided in a fuel feeding line on the upstream side of the branching point of the fuel control line.

7. The pressure storage fuel injection system according to claim 2, wherein the boosting piston further includes:

a small diameter part slidably disposed in the first cylinder chamber; and a large diameter part slidably disposed in a second cylinder chamber formed adjacent to the first cylinder chamber and operatively coupled to the small diameter part.

8. The pressure storage fuel injection system according to claim 7, wherein a spring is accommodated in at least one of the first and second cylinder chambers for biasing the small diameter part of the boosting piston in a direction of increasing the volume of the first cylinder chamber.

9. The pressure storage fuel injection system according to claim 8, wherein the boosting piston includes as separate parts a small diameter part slidably disposed in the first cylinder chamber and a large diameter part slidably disposed in the second cylinder chamber.

10. The pressure storage fuel injection system according to claim 7, wherein a spring is accommodated in at least the first cylinder chamber for biasing the small diameter part of the boosting piston in a direction of increasing the volume of the first cylinder chamber.

11. The pressure storage fuel injection system according to claim 7, wherein the second cylinder chamber is partitioned by the large diameter part of the boosting piston into two sub-chambers, one being adjacent to the first cylinder chamber, the other not being adjacent to the first cylinder chamber.

12. The pressure storage fuel injection system according to claim 7, wherein the fuel supply circuit is operable to introduce the fuel pressure to one of several sub-chambers in the second cylinder chamber to cause sliding of the large diameter part of the boosting piston with a pressure corresponding to the area difference between the large and small diameter parts such as to reduce the volume of the first cylinder chamber, thus boosting the fuel pressure on the downstream side of the first cylinder chamber.

13. The pressure storage fuel injection system according to claim 11, wherein the fuel supply circuit includes a first fuel line for applying the fuel pressure to the one of the sub-chambers, and a second fuel line for applying the fuel pressure to the other sub-chamber, the second directional control valve provided in the second fuel line being operable for switching to apply pressure to the other sub-chamber so as to prohibit the sliding of the large diameter part of the boosting piston and thus render the boosting piston inoperative and cease the application of pressure to the other sub-chamber so as to allow sliding of the large diameter part of the boosting piston and thus render the boosting piston operative for boosting the fuel pressure.

14. The pressure storage fuel injection system according to claim 11, wherein the fuel supply circuit includes a first fuel line for applying pressure to one of the sub-chambers and a third fuel line for communicating the other sub-chamber with atmosphere, the pressure application to the one sub-chamber being caused to allow sliding of the large diameter part of the boosting piston and thus render the boosting piston operative for boosting the fuel pressure and being caused to prohibit sliding of the large diameter portion of the boosting piston and render the boosting piston inoperative.

15. The pressure storage fuel injection system according to one of claims 12 to 14, wherein the pressure in the fuel supply circuit is the fuel pressure in the fuel feeding line on the upstream side of the first cylinder chamber.

16. The pressure storage fuel injection system according to claim 1, wherein the first cylinder chamber is formed as an increased sectional area portion of the fuel feeding line, the outlet of the fuel feeding line to the first cylinder chamber being opened when the boosting piston is rendered inoperative and closed when the boosting piston is rendered operative.

17. A pressure storage fuel injection system comprising:

fuel feeding means for feeding fuel of a predetermined pressure;

a pressure storage for storing fuel fed out from the fuel feeding means in a pressurized state;

a fuel feeding line for feeding fuel from the pressure storage to a fuel pool provided in a fuel injection valve for fuel to be injected;

operating fluid feeding means for feeding pressurized operating fluid;

a valve control line for supplying the operating fluid from the operating fluid feeding means to an operating fluid chamber formed for on-off control of a needle valve in the fuel injection valve;

a first directional control valve provided for fuel injection control in the valve control line, the first directional control valve being operable to apply an operating fluid pressure to the operating fluid chamber so as to close the needle valve in the fuel injection valve and cease application of the operating fluid pressure to the operating fluid chamber so as to open the needle valve;

a first cylinder chamber formed in the fuel feeding line;

a boosting piston provided in the first cylinder chamber and operable for reducing a volume of the first cylinder chamber so as to boost fuel pressure on a downstream side of the first cylinder chamber;

a boosting piston control line for supplying the operating fluid from the operating fluid feeding means to the boosting piston;

a second directional control valve provided for operating the boosting piston in the boosting piston control line and operable to on-off switch application of operating fluid to the boosting piston, thus driving the boosting piston; and a controller for providing control signals to the first directional control valve for the fuel injection control and the second directional control valve for operating the boosting piston to control the on-off control of the needle valve and operation of the boosting piston.

18. The pressure storage fuel injection system according to claim 17, wherein the fuel is also used as the operating fluid.

19. The pressure storage fuel injection system according to claim 18, wherein the fuel feeding means is also used as the operating fluid feeding means.

* * * * *